US007128389B2

(12) United States Patent
Okamoto et al.

(10) Patent No.: US 7,128,389 B2
(45) Date of Patent: Oct. 31, 2006

(54) INKJET PRINTER

(75) Inventors: Tsugio Okamoto, Gifu (JP); Susumu Kuzuya, Gifu (JP); Atsuhisa Nakashima, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 185 days.

(21) Appl. No.: 10/902,807

(22) Filed: Aug. 2, 2004

(65) Prior Publication Data

US 2005/0036022 A1 Feb. 17, 2005

(30) Foreign Application Priority Data

Aug. 5, 2003 (JP) ..... 2003-287156

(51) Int. Cl.
*B41J 2/165* (2006.01)

(52) U.S. Cl. ..... 347/29; 347/32

(58) Field of Classification Search ..... 347/29, 347/30

See application file for complete search history.

(56) References Cited

U.S. PATENT DOCUMENTS

| | | | | |
|---|---|---|---|---|
| 6,293,648 | B1 * | 9/2001 | Anderson | 347/29 |
| 6,578,945 | B1 * | 6/2003 | Hashi et al. | 347/22 |
| 2002/0044168 | A1 | 4/2002 | Hashi et al. | |
| 2005/0057602 | A1 | 3/2005 | Okamoto | |

FOREIGN PATENT DOCUMENTS

| | | |
|---|---|---|
| JP | A-5-330080 | 12/1993 |
| JP | A-05-330080 | 12/1993 |
| JP | A-7-186396 | 7/1995 |
| JP | A-9-085959 | 3/1997 |
| JP | A-9-123470 | 5/1997 |
| JP | A-09-123470 | 5/1997 |
| JP | A 2000-343716 | 12/2000 |
| JP | A-2002-120386 | 4/2003 |
| JP | A-2004-268495 | 9/2004 |
| JP | A-2004-291482 | 10/2004 |

* cited by examiner

*Primary Examiner*—Stephen Meier
*Assistant Examiner*—Ly T Tran
(74) *Attorney, Agent, or Firm*—Oliff & Berridge, PLC

(57) ABSTRACT

An inkjet printer includes an inkjet head, a sealing member, a conveyance unit, a first moving unit, and a second moving unit. The first moving unit moves the sealing member along an outer circumference of the conveyance belt between a first position and a second position. The first position is located above the conveyance belt and faces the nozzle surface of the inkjet head. The second position is located under the conveyance belt. The second moving unit moves the conveyance belt between a conveyable position and a separate position. When the conveyance belt is located at the conveyable position and the sealing member is located at the first position, the conveyance belt presses the sealing member toward the nozzle surface so that the sealing member covers the nozzle surface.

14 Claims, 14 Drawing Sheets

INKJET PRINTER

BACKGROUND OF THE INVENTION

1. Field of the Invention

The present invention relates to an inkjet printer, and particularly relates to an inkjet printer in which it is unnecessary to move an inkjet head to cover the nozzle surface thereof with a sealing member, so that the printing accuracy can be improved, while the moving path of the sealing member is set under the inkjet head so that ink can be prevented from adhering to the inkjet head.

2. Description of the Related Art

In an inkjet printer, nozzles for ejecting ink are exposed to the air. Accordingly, there is a fear that ink in the nozzles is evaporated to clog the nozzles when ink ejection is not performed. Therefore, the nozzle surface of the inkjet head is generally capped (covered) with a cap member (sealing member) to prevent the ink from being evaporated when the ink ejection operation is suspended for a long time.

The cap member is disposed out of a printing area. The capping of the nozzle surface is carried out as follows. The inkjet head is moved horizontally from a printing position to a retraction position, that is, to the position where the cap member is disposed. However, when the inkjet head is formed as a line head, the cap member is made large in size because the head is made long. Thus, there is a problem that the retraction space is also expanded so that the inkjet printer as a whole is made large in size.

Therefore, various techniques for reducing the retraction space to thereby miniaturize an inkjet printer have been proposed. For example, JP-A-2000-343716 (e.g., paragraph 0033 and FIG. 4) discloses a technique for miniaturizing an inkjet printer. JP-A-2000-343716 includes a chain mechanism provided circumferentially to surround a head base, a plurality of maintenance members disposed around the whole circumference of the chain mechanism, and gap portions provided among head chips. The maintenance members are moved alternately via the positions (capping positions) opposed to the head chips and via the gap portions (retraction positions), respectively.

SUMMARY OF THE INVENTION

However, in the aforementioned inkjet printer, the head chips have to be moved toward the maintenance members at the time of capping. Accordingly, the head chips have to be supported movably so that a support mechanism therefor becomes complicated. Thus, there is a problem that the positional accuracy of the head chips is apt to get out of order so as to degrade the printing accuracy.

In addition, in the aforementioned inkjet printer, the maintenance members move surrounding the circumference of the head chips. Accordingly, when the maintenance members pass above the head chips, ink ejected in a purging process or the like and reserved in the maintenance members may flow down onto the head chips. Thus, there is a problem that not only are the head chips contaminated with the ink, but an electric system is also short-circuited due to the flowing-down ink so as to cause damage or failure of the head chips.

The invention was developed to solve the forgoing problems. The invention provides an inkjet printer in which it is unnecessary to move an inkjet head to cover the nozzle surface thereof with a sealing member, so that the printing accuracy can be improved, while the moving path of the sealing member is set under the inkjet head so that ink can be prevented from adhering to the inkjet head.

In order to attain the foregoing object, according to one embodiment of the invention, an inkjet printer includes an inkjet head, a sealing member, a conveyance unit, a first moving unit, and a second moving unit. The inkjet head includes a plurality of nozzles that eject ink. The sealing member covers a nozzle surface of the inkjet head. The conveyance unit includes an endless conveyance belt that carries a recording medium in a conveyance direction substantially parallel to the nozzle surface. The first moving unit moves the sealing member along an outer circumference of the conveyance belt between a first position and a second position. The first position is located above the conveyance belt and faces the nozzle surface of the inkjet head. The second position is located under the conveyance belt. The second moving unit moves the conveyance belt between a conveyable position and a separate position. The conveyable position is close to the nozzle surface of the inkjet head. The separate position is separated from the nozzle surface. When the conveyance belt is located at the conveyable position and the sealing member is located at the first position, the conveyance belt presses the sealing member toward the nozzle surface so that the sealing member covers the nozzle surface. When the sealing member is located at the first position and the second moving unit moves the conveyance belt from the conveyable position to the separate position, the sealing member is separate from the nozzle surface.

With this configuration, when the conveyance belt is located at the conveyable position and the sealing member is located at the first position, the conveyance belt presses the sealing member toward the nozzle surface so that the sealing member covers the nozzle surface. Accordingly, the nozzle surface can be covered with the sealing member with the ink-jet head being fixed. In the operation of covering the nozzle surface with the sealing member, it is therefore unnecessary to move the inkjet head as in the background-art inkjet printer, but the inkjet head can be designed to be fixed. Thus, there is an effect that the positional accuracy of the inkjet head is secured so that the printing accuracy can be improved correspondingly.

In addition, after the operation of covering the nozzle surface with the sealing member is terminated, the first moving unit may move the sealing member along the outer circumference of the conveyance belt to the second position located under the conveyance belt. Thus, there is an effect that ink ejected in a purging process or the like and reserved in the sealing member can be prevented from flowing down onto the inkjet head. As a result, it is possible to avoid such an accident that the inkjet head is contaminated with the ink flowing down or an electric system is short-circuited due to the ink flowing down so that the inkjet head can be prevented from being damaged or failing.

DETAILED DESCRIPTION OF THE PREFERRED EMBODIMENT

Figure 1:
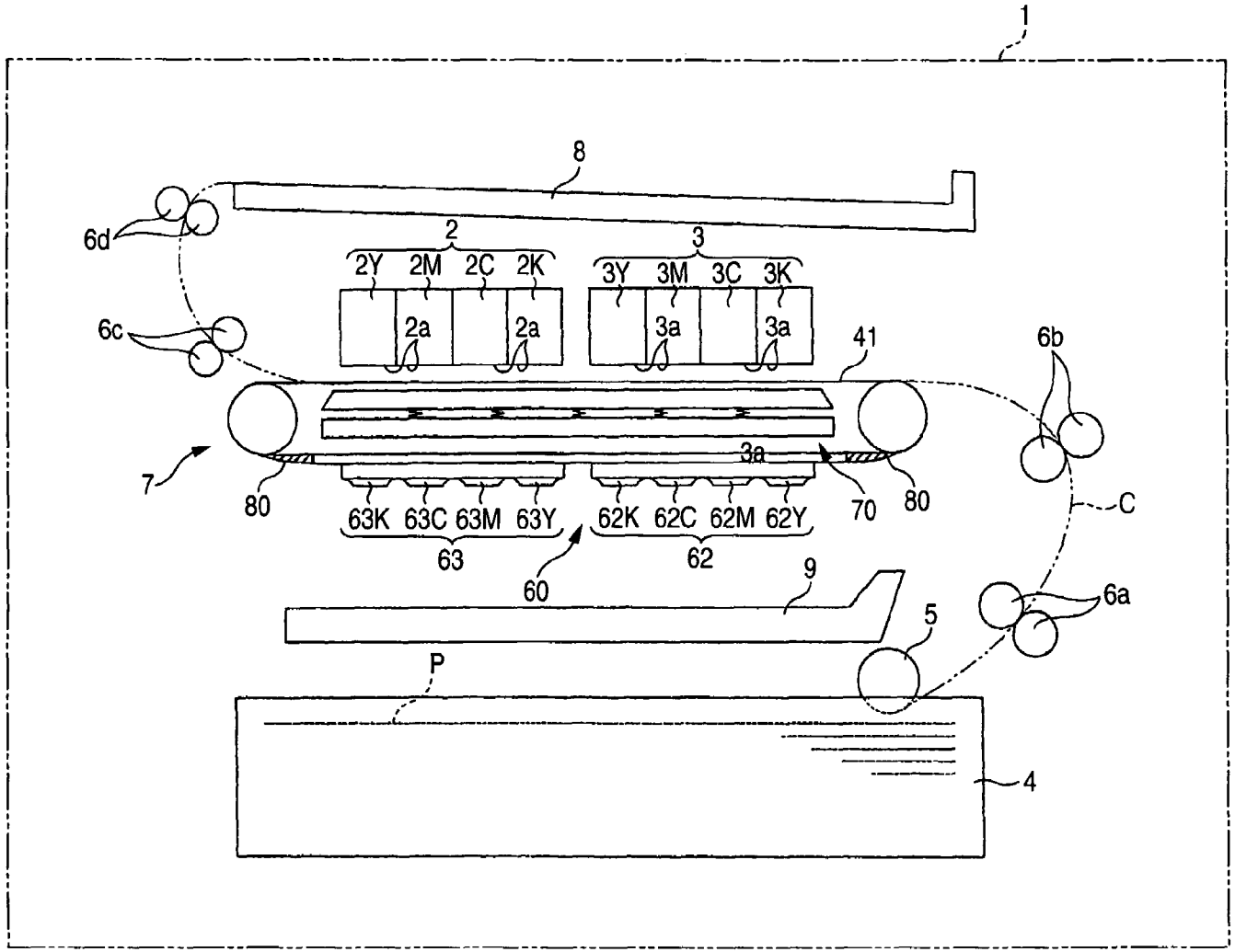
FIG. 1 is a schematic view schematically showing the overall configuration of an inkjet printer according to an embodiment of the invention.

A preferred embodiment of the invention will be described below with reference to the accompanying drawings. FIG. 1 is a schematic view schematically showing the overall configuration of an inkjet printer 1 according to the embodiment of the invention. In FIG. 1, a conveyance path C of recording paper (recording medium) P is shown by use of the chain double-dashed line.

The inkjet printer 1 is designed as a line type printer that has first and second head units 2 and 3, and can print a full-line image without scanning the recording medium in the width direction thereof with the first and second head units 2 and 3. As shown in FIG. 1, the inkjet printer 1 chiefly includes a paper feed cassette 4, a paper feed roller 5, guide rollers 6*a*–6*d*, a conveyance belt unit 7 serving as a constituent component of a conveyance unit for conveying the recording medium, a paper discharge tray 8 and an ink reception member 9.

Inks of four colors (cyan, magenta, yellow and black) are supplied from ink tanks (not shown) to the first head unit 2. The first head unit 2 ejects the inks onto the recording paper P so as to print an image thereon. In the first head unit 2, four print heads 2Y, 2M, 2C and 2K corresponding to the colors respectively are provided integrally in parallel. A nozzle surface 2*a* is formed in the lower surface (the surface on the lower side in FIG. 1) of each print head 2Y–2K, and a plurality of nozzles (not shown) capable of ejecting ink are disposed in each nozzle surface 2*a*.

Each print head 2Y–2K is a line type head whose longitudinal direction extends in the width direction (the direction perpendicular to the paper of FIG. 1) of the recording paper P. In this embodiment, four units each having 664 nozzles arrayed in the form of a 16-colum two-dimensional matrix are provided in series in the width direction (the direction perpendicular to the paper of FIG. 1) of the conveyance belt unit 7 which will be described later.

Incidentally, the second head unit 3 has the same configuration as the first head unit 2, and description thereof will be omitted. Each of the first and second head units 2 and 3 is formed to have a length approximately half as large as the width-direction (the direction perpendicular to the paper of FIG. 1) length of the conveyance belt unit 7 which will be described later. In addition, the head units 2 and 3 are disposed so that their end portions overlap each other when viewed from the conveyance direction of the recording paper P. Accordingly, a full-line image can be printed without forming any blank between the head units 2 and 3 adjacent to each other.

Here, inks are supplied from the ink tanks to the first and second head units 2 and 3 through supply tubes (not shown) connecting the ink tanks with the first and second head units 2 and 3 respectively. Accordingly, in the configuration where the heads are moved to capping positions at the time of capping as in a serial type inkjet printer in which the heads are moved in the width direction, the supply tubes are moved together with the heads. Thus, it is necessary to secure a space where the supply tubes can move. The necessity causes not only a larger size of the apparatus as a whole but also air mixture into the inks.

However, as will be described later, the inkjet printer 1 according to this embodiment is designed to be able to perform not only a printing operation but also a capping operation in the state where the first head units 2 and 3 are fixed perfectly. Accordingly, it is unnecessary to secure the space where the supply tubes can move, so that it is possible to miniaturize the apparatus as a whole. In addition, the air can be prevented from being mixed into the inks. Incidentally, the capping operation will be described in detail later.

The paper feed cassette 4 stores a stack of sheets of A4-size recording paper P by way of example. The paper feed cassette 4 is formed as a substantially box-like body open on its top side (the upper side in FIG. 1). A paper support plate on which the recording paper P will be mounted, and a compression spring for urging the paper support plate upward (to the upper side in FIG. 1) are provided inside the paper feed cassette 4 (both of the paper support plate and the compression spring are not shown). Thus, the paper feed roller 5 which will be described later can always abut against the recording paper P regardless of the number of remaining sheets of the recording paper P.

The paper feed roller 5 is disposed on the front end side (the right side in FIG. 1) of the paper feed cassette 4. The paper feed roller 5 is a roller for taking out the recording paper P from the paper feed cassette 4 and feeding it to the conveyance path C. The paper feed roller 5 is formed to be circular in section. A material having a high friction coefficient such as silicon rubber is circumferentially attached to the outer circumferential surface of the paper feed roller 5, so as to prevent the paper feed roller 5 from running idle when the paper feed roller 5 touches the surface of the recording paper P.

The guide rollers 6*a*–6*d* are members for guiding the recording paper P along the conveyance path C. As shown in FIG. 1, each guide roller 6*a*–6*d* is constituted by a pinch roller and a rubber roller disposed to be opposed to each other. The recording paper P fed from the paper feed cassette 4 onto the conveyance path C by the paper feed roller 5 is guided onto the conveyance belt unit 7, which will be described later, by the guide rollers 6*a* and 6*b*. When printing is terminated, the recording paper P is guided by the guide rollers 6*c* and 6*d* so as to be discharged from the conveyance belt unit 7 onto the paper discharge tray 8 which will be described later.

The conveyance belt unit 7 drives the conveyance belt 41 so as to convey the recording paper P. The conveyance belt unit 7 also has a function of pressing the capping unit 60 (first and second cap members 62 and 63) onto the nozzle surfaces 2*a* and 3*a* of the first and second head units 2 and 3 in order to cap the nozzle surfaces 2*a* and 3*a* (see FIG. 9). The conveyance belt unit 7 is disposed to face the nozzle surfaces 2*a* and 3*a* of the first and second head units 2 and 3. The conveyance belt unit 7 chiefly includes the conveyance belt 41, the capping unit 60, a belt seat unit 70, etc. as shown in FIG. 1. The conveyance belt 41 conveys the recording paper P. The conveyance belt 41 is formed out of a flexible material and into an endless shape. In addition, the outer surface of the conveyance belt 41 is made adhesive enough to suck and convey the recording paper P.

The capping unit 60 caps (covers) the nozzle surfaces 2*a* and 3*a* so as to prevent ink from being evaporated during long-term suspension of printing or to recover ink in a purging processor the like. The capping unit 60 is formed to be movable along the outer circumference of the conveyance belt 41 between a retraction position (non-sealing position) under the conveyance belt unit 7 as shown in FIG. 1 and a capping position (sealing position, see FIG. 9) opposed to the nozzle surfaces 2*a* and 3*a*. On the other hand, the belt seat unit 70 presses the capping unit 60 toward the nozzle surfaces 2*a* and 3*a* at the time of capping, so as to bring the capping unit 60 into close contact with the nozzle surfaces 2*a* and 3*a* (see FIG. 9). Incidentally, the detailed configuration of the conveyance belt unit 7 including the members 60 and 70 will be described later.

The paper discharge tray 8 to which the recording paper P having a desired image printed thereon will be discharged is disposed on the most downstream side of the conveyance path C. The ink reception member 9 having a substantially box-like shape open on its top (the surface on the upper side in FIG. 1) is disposed under the conveyance belt unit 7 (on the lower side in FIG. 1). The ink reception member 9 is a member for recovering waste ink flowing down from the capping unit 60 retracted in the retraction position shown in FIG. 1. An ink absorbing member (not shown) for absorbing and retaining the waste ink is received inside the ink reception member 9.

In such a manner, in the inkjet printer 1 according to this embodiment, the capping unit 60 is retracted under the conveyance belt 41 (on the lower side in FIG. 1) while being moved along the outer circumference of the conveyance belt 41. Thus, the capping unit 60 is designed to allow the ink reception member 9 to recover the waste ink in the capping unit 60 under the conveyance belt 41. Accordingly, it can be surely prevented that the ink adheres to the conveyance belt 41 having adhesiveness and then the adhering ink contaminates the recording paper P.

In addition, since the retraction position of the capping unit 60 is set under the conveyance belt 41, the space under the conveyance belt 41 is put into effective use so that the inkjet printer 1 as a whole can be miniaturized. In addition, the waste ink can be made to flow down to the ink reception member 9 easily and surely by use of its own gravity. Accordingly, it is unnecessary to provide a recovery drive source (such as a suction pump), a recovery path (such as a suction tube) or the like for the waste ink separately, so that the apparatus cost can be reduced. Incidentally, the detailed configuration of the capping unit 60 will be described later.

Figure 2:
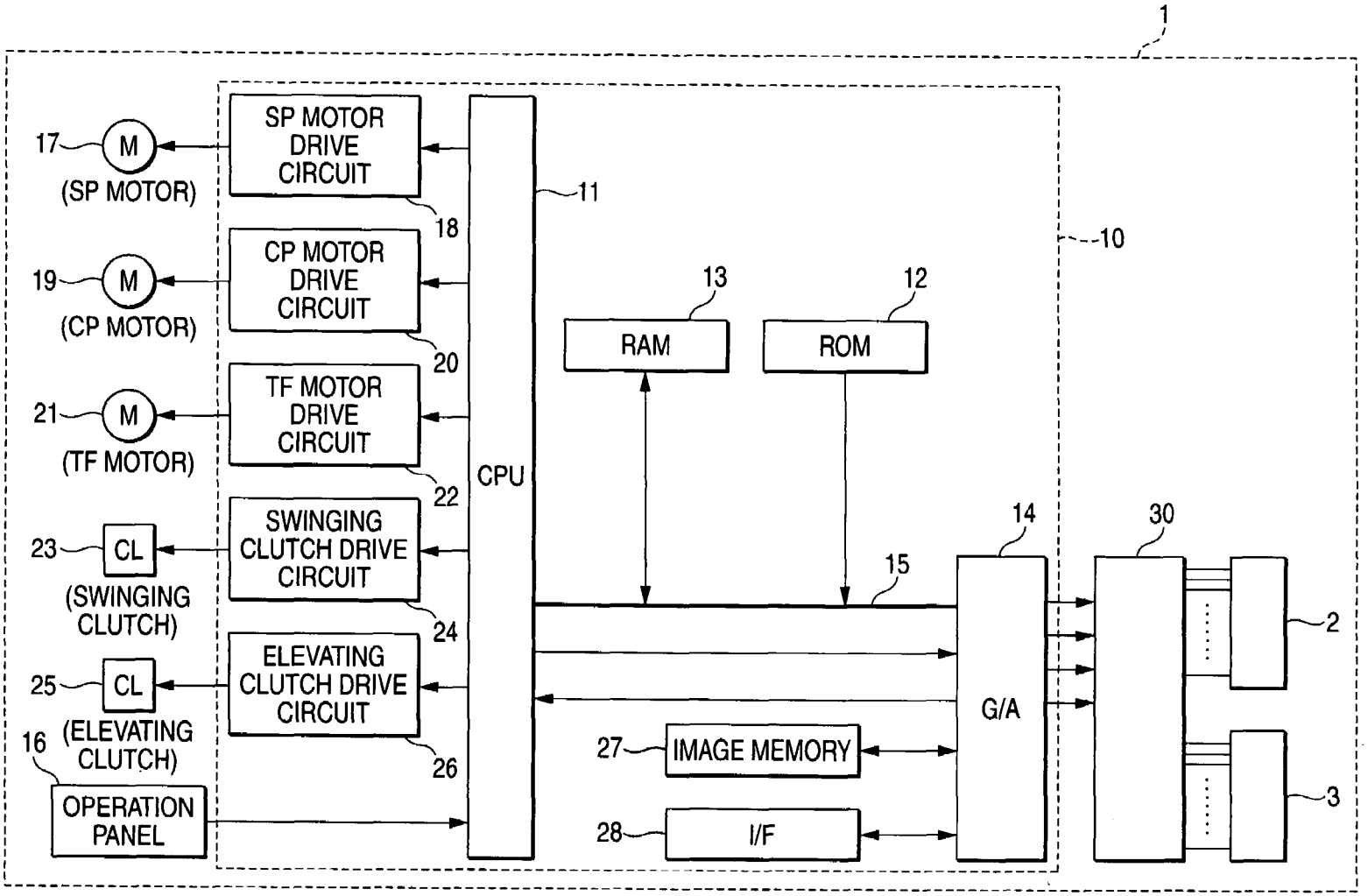
FIG. 2 is a block diagram showing the electric configuration of the inkjet printer.

FIG. 2 is a block diagram showing the electric configuration of the inkjet printer 1. As shown in FIG. 2, the inkjet printer 1 includes a main control board 10, and a sub-control board 30 for controlling the first and second head units 2 and 3.

The main control board 10 is mounted with a microcomputer (CPU) 11, a ROM 12, a RAM 13, a gate array (G/A) 14, etc. The CPU 11 has a one-chip configuration. The ROM 12 is a read-only memory for storing fixed-value data including various control programs to be executed by the CPU 11, and the like. The RAM 13 is a rewritable volatile memory for temporarily storing various data and the like. The ROM 12, the RAM 13 and the G/A 14 are connected to the CPU 11 through a bus line 15.

The CPU 11 serving as an arithmetic unit executes various process in accordance with the control programs stored in the ROM 12 in advance. In addition, the CPU 11 generates a printing timing signal and a reset signal, and transfers the signals to the G/A 14, which will be described later.

In addition, an operation panel 16, an SP motor drive circuit 18, a CP motor drive circuit 20, a TF motor drive circuit 22, a swinging clutch drive circuit 24, an elevating clutch drive circuit 26, etc. are connected to the CPU 11. A user gives instructions for printing and the like through the operation panel 16. The SP motor drive circuit 18 drives an SP motor 17 for supplying a torque to the paper feed roller 5 (see FIG. 1). The CP motor drive circuit 20 drives a CP motor 19 for moving the capping unit 60 (see FIG. 1) to the capping position or there traction position. The TF motor drive circuit 22 drives a TF motor 21 for supplying a torque to the conveyance belt 41 and performing a swinging operation or an elevating operation of the conveyance belt 41. The swinging clutch drive circuit 24 drives and controls a swinging clutch 23 for changing over between disconnection and connection of the torque to be transmitted from the output shaft of the TF motor 21 to a swinging shaft 54 (see FIG. 6). The elevating clutch drive circuit 26 drives and controls an elevating clutch 25 for changing over between disconnection and connection of the torque to be transmitted from the output shaft of the TF motor 21 to an elevating shaft 50 (see FIG. 6). The CPU 11 controls the operation of each device connected thus.

The G/A 14 outputs print data (driving signal), a transfer clock, a latch signal, a parameter signal and an ejection timing signal in accordance with the printing timing signal transferred from the CPU 11 and image data stored in an image memory 27. The image data is printed on the recording medium based on the print data. The transfer clock is synchronized with the print data. A reference printing waveform signal is generated from the parameter signal. The ejection timing signal is output in a constant period. The G/A 14 transfers those signals to the sub-control board 30 mounted with a head driver.

In addition, the G/A 14 stores image data into the image memory 27. The image data is transferred from external equipment such as a computer through an interface (I/F) 28. The G/A 14 generates a data reception interrupt signal based on data transferred from a host computer or the like through the I/F 28, and transfers the signal to the CPU 11. Incidentally, each signal communicated between the G/A 14 and the sub-control board 30 is transferred through a harness cable connecting the both.

The sub-control board 30 is a board for driving the first and second head units 2 and 3 through ahead driver (drive circuit) mounted on the sub-control board 30. The head driver is controlled through the G/A 14 mounted on the main control board 10, so as to apply a drive pulse of waveform corresponding to a recording mode to each drive element of the first and second head units 2 and 3. Thus, a predetermined amount of ink is ejected from each nozzle to the recording paper P.

Figure 3:
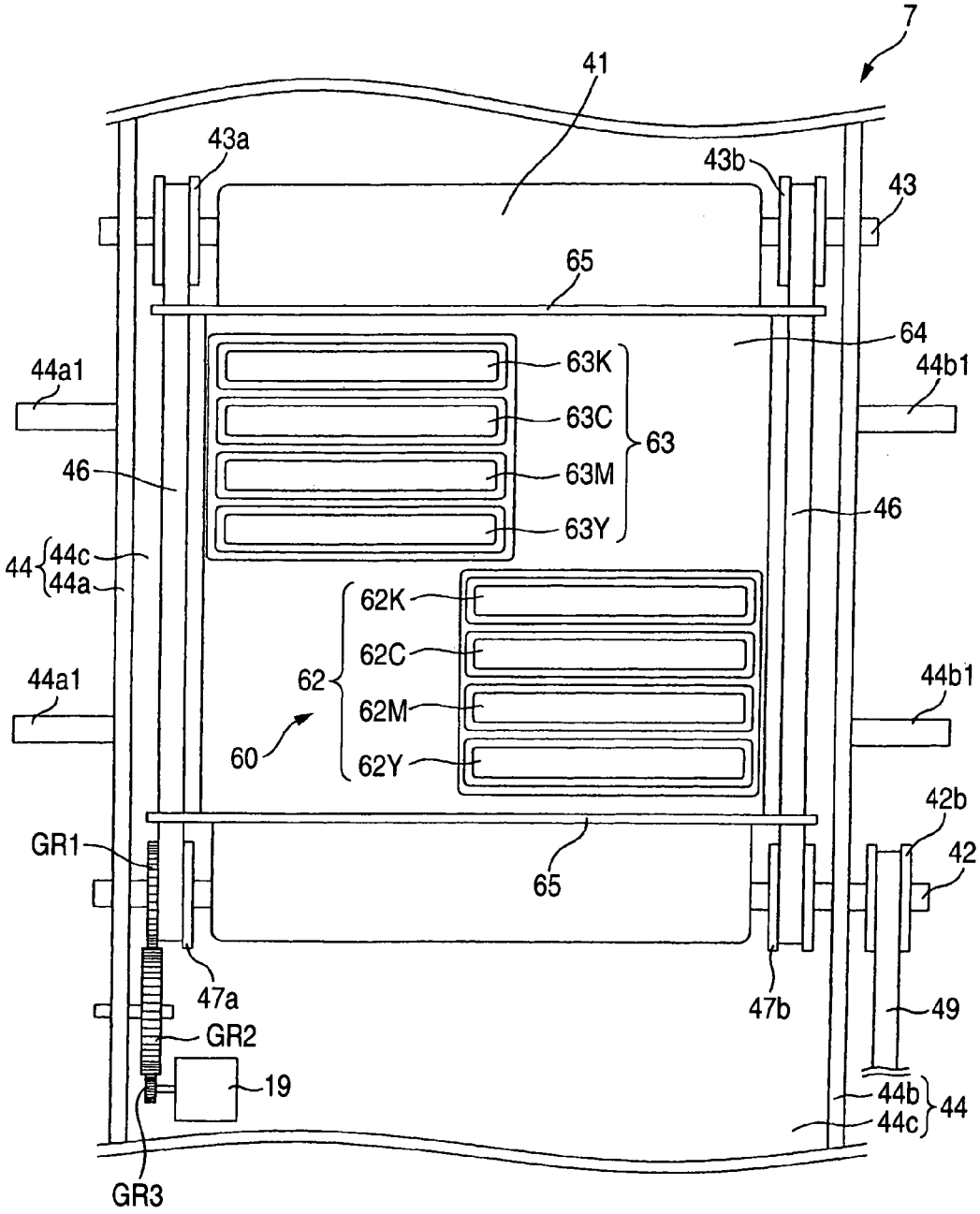
FIG. 3 is a top view of a conveyance belt unit.
Figure 4:
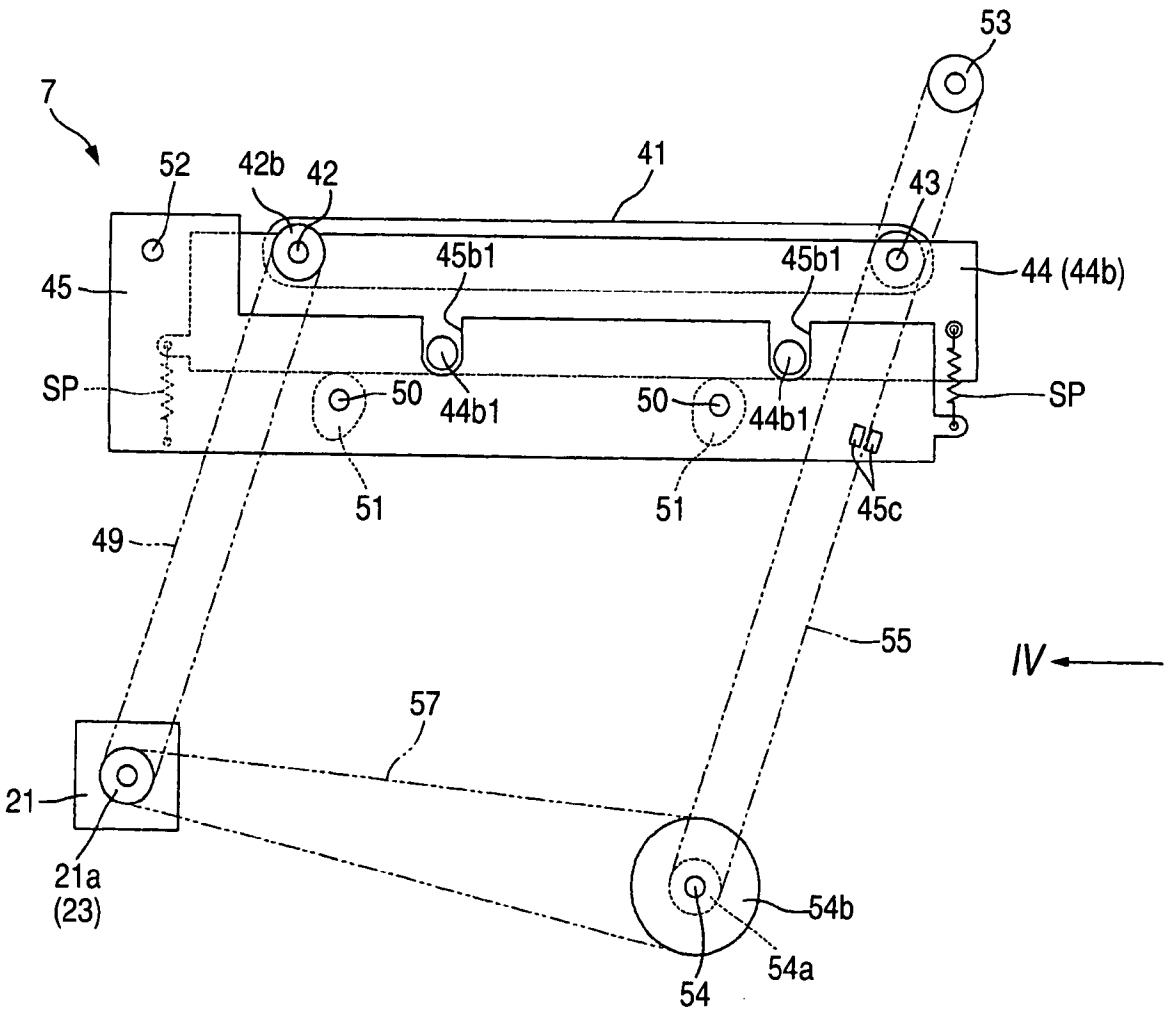
FIG. 4 is a side view of the conveyance belt unit.
Figures 12A, 12B:
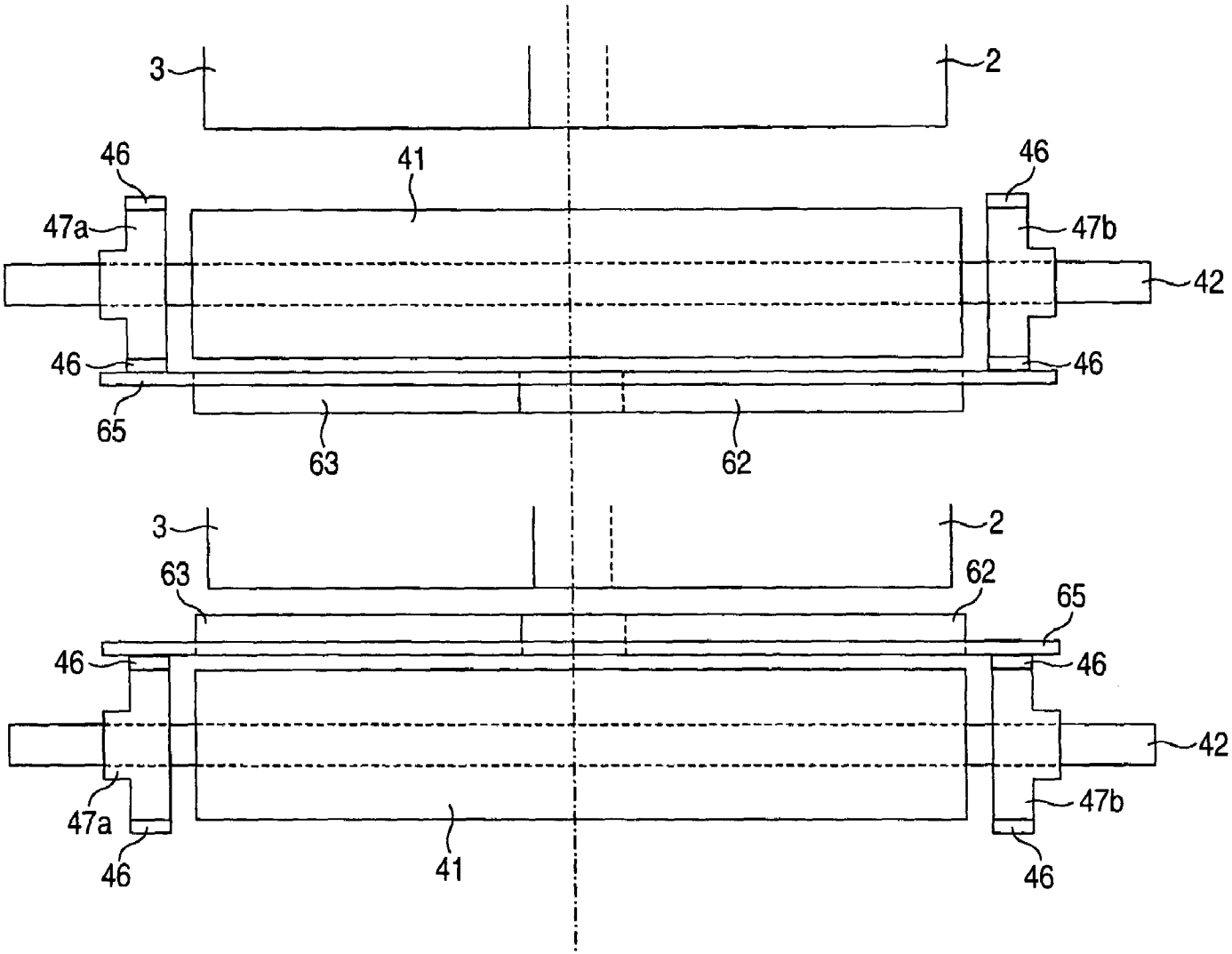
FIG. 12 is front views of the conveyance unit 7 observed from the left side of FIG. 1 (from the lower side of FIG. 3).
Figure 12C:
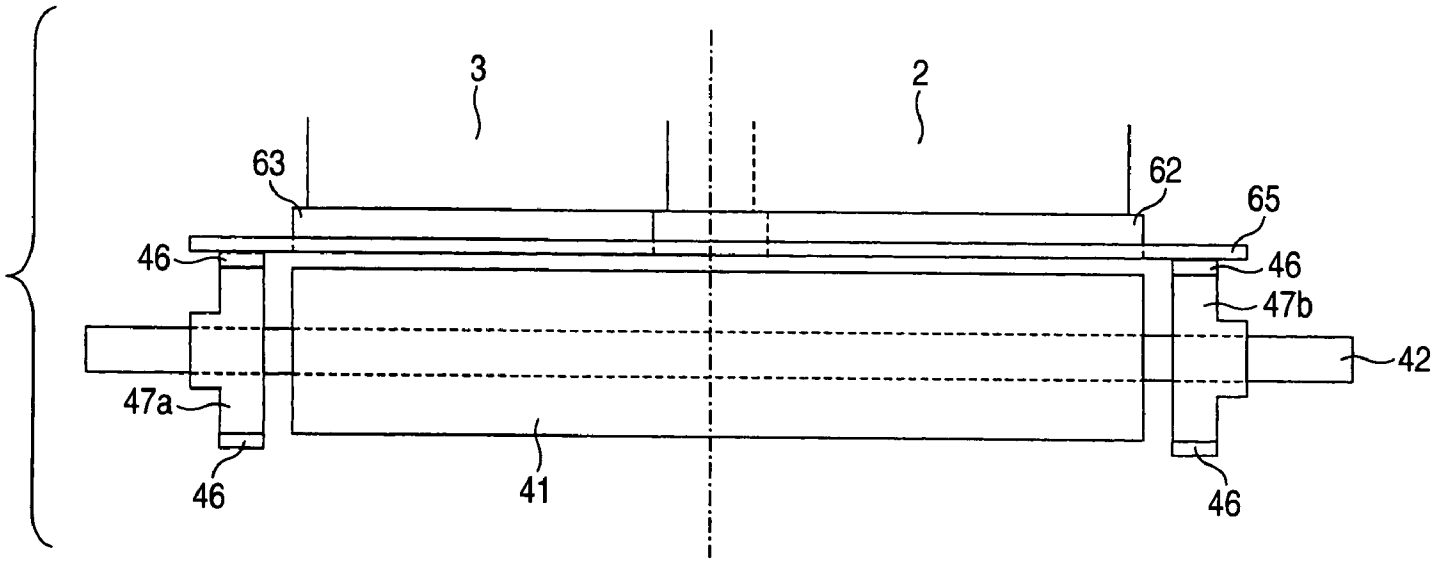

Next, description will be made on the detailed configuration of the conveyance belt unit 7 with reference to FIGS. 3, 4 and 12. FIG. 3 is a top view of the conveyance belt unit 7 observed from the side of the first and second head units 2 and 3, which are not shown. FIG. 4 is a side view of the conveyance belt unit 7. FIG. 12 is front views of the conveyance unit 7 observed from the left side of FIG. 1 (from the lower side of FIG. 3). Incidentally, a part of the conveyance belt unit 7 is not shown in each of the drawings. In addition, FIG. 3 shows the state where the capping unit 60 has been moved to the capping position opposed to the nozzle surfaces 2*a* and 3*a* (see FIG. 1) of the first and second head units 2 and 3. FIG. 12A shows the state where the capping unit 60 is located at the retraction position under the conveyance unit 7. FIG. 12B shows the state where the capping unit 60 is located at the capping position and is apart from the nozzle surfaces 2*a* and 3*a*. FIG. 12C shows the state where the capping unit caps (covers) the nozzle surfaces 2*a* and 3*a*.

The conveyance belt unit 7 has a function of driving the conveyance belt 41 to thereby convey the recording paper P and a function of pressing the capping unit 60 onto the nozzle surfaces 2*a* and 3*a* (see FIG. 9) as described above. The conveyance belt unit 7 chiefly includes the conveyance belt 41, a driving shaft 42, a driven shaft 43, a side wall frame 44 and a body frame 45. The conveyance belt 41 is wound on the driving shaft 42 and the driven shaft 43. The shafts 42 and 43 are rotatably supported on the side wall frame 44. The side wall frame 44 is supported by the body frame 45 so as to be movable up and down.

Figure 5A:
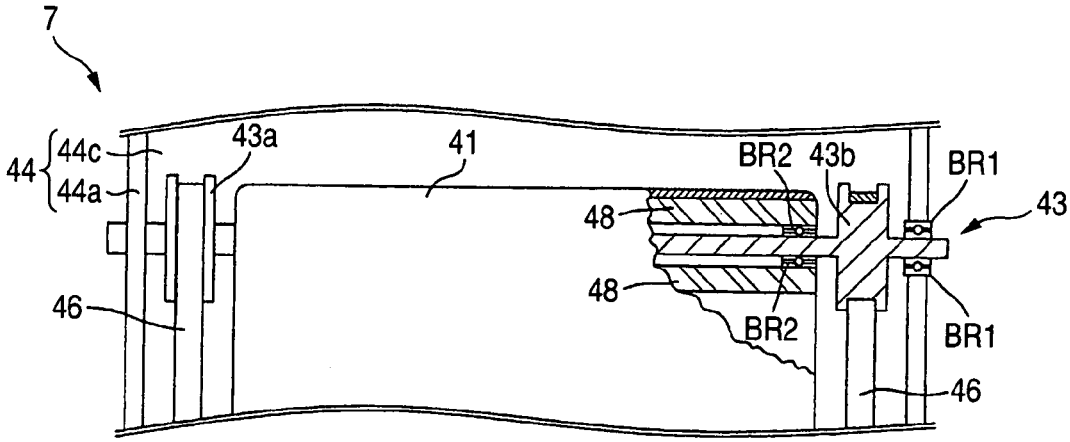
FIG. 5A is a partially sectional view of the conveyance belt unit on the driven shaft side.
Figure 5B:
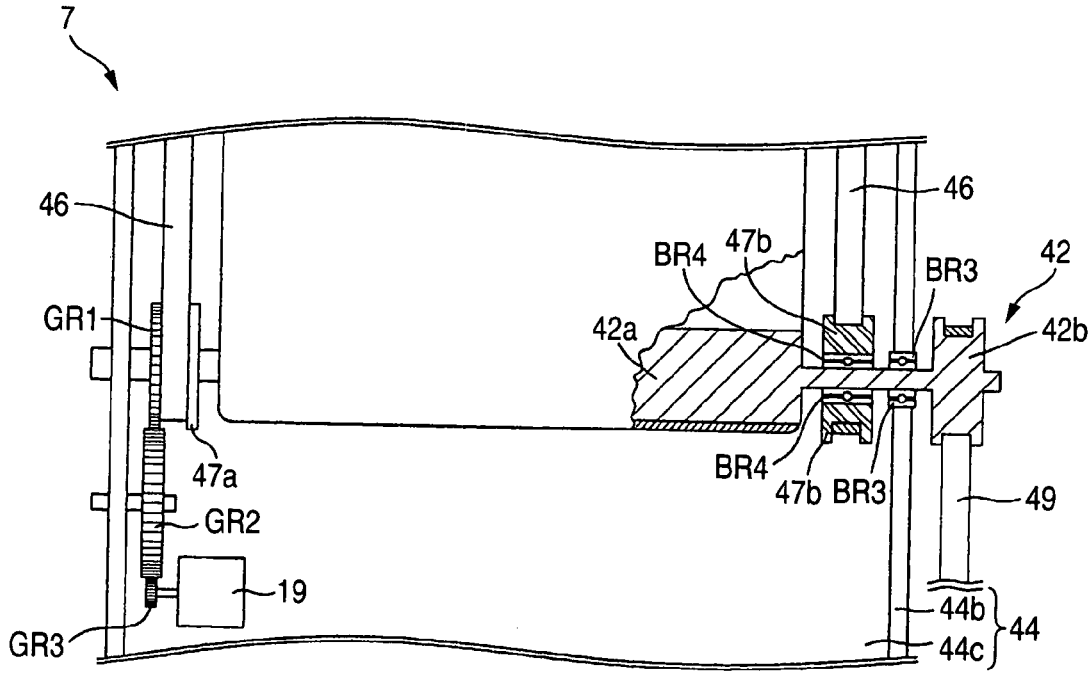
FIG. 5B is a partially sectional view of the conveyance belt unit on the driving shaft side.

The side wall frame 44 is a member to which the conveyance belt 41 and transmission belts 46 are attached through the driving shaft 42 and the driven shaft 43. The side wall frame 44 is formed integrally by injection molding out of a synthetic resin material. As shown in FIGS. 4 and 5A–5B, the side wall frame 44 includes a pair of left and right side plates 44*a* and 44*b* provided erectly to face each other on the width-direction (left/right direction in FIG. 2) opposite sides of the conveyance belt 41, and a bottom wall 44*c* connecting the side plates 44*a* and 44*b* on the lower surface side of the conveyance belt 41 (on the deep side of the paper of FIG. 4), so as to be formed into a substantially U-shape in section.

The conveyance belt 41 and the pair of transmission belts 46 provided in parallel on the width-direction opposite sides of the conveyance belt 41 are disposed between the opposed surfaces of the side walls 44*a* and 44*b*. The belts 41 and 46 are wound on and between the driving shaft 42 and the driven shaft 43 as shown in FIGS. 3 and 4. The driving shaft 42 and the driven shaft 43 are rotatably supported between the side walls 44*a* and 44*b* of the side wall frame 44. Here, description will be made on the detailed configuration of the driving shaft 42 and the driven shaft 43 with reference to FIGS. 5A and 5B.

FIG. 5A is a partially sectional view of the conveyance belt unit 7 on the driven shaft 43 side, and FIG. 5B is a partially sectional view of the conveyance belt unit 7 on the driving shaft 42 side. Incidentally, in FIGS. 5A and 5B, the driven shaft 43 and the driving shaft 42 are shown in sectional view substantially taken along their shaft axes respectively, while a part of the conveyance belt unit 7 is not shown.

The driven shaft 43 is rotatably supported on the side walls 44*a* and 44*b* through bearings BR1 as shown in FIG. 5A. A pair of driven shaft pulleys 43*a* and 43*b* are formed integrally on the both ends of the driven shaft 43. The driven shaft pulleys 43*a* and 43*b* are members on which the transmission belts 46 are wound. Gears are engraved in the belt seat surfaces of the driven shaft pulleys 43*a* and 43*b* so as to be able to engage with the transmission belts 46 formed as timing belts. Accordingly, when the driven shaft 43 or the transmission belts 46 are rotated, the torque thereof can be transmitted to the transmission belts 46 or the driven shaft 43 through the driven shaft pulleys 43*a* and 43*b* efficiently and accurately.

In addition, in the substantially central portion of the driven shaft 43 in its axial direction (the left/right direction in FIG. 5A), a driven shaft roller 48 (rotating member rotatably supported on the driven shaft 43) is put between the driven shaft 43 and the conveyance belt 41. The driven shaft roller 48 is a member for rotatably supporting the conveyance belt 41. The driven shaft roller 48 is coupled with the driven shaft 43 through bearings BR2 as shown in FIG. 5A. Thus, the driven shaft roller 48 is designed to be able to run idle with respect to the driven shaft 43.

Accordingly, when the driven shaft 43 is rotated, the torque thereof is blocked by the bearings BR2. Thus, the torque is hardly transmitted to the driven shaft roller 48 so that the conveyance belt 41 can be kept at rest. In the same manner, when the conveyance belt 41 is rotated, the torque thereof is blocked by the bearings BR2. Thus, the torque is hardly transmitted to the driven shaft 43 so that the driven shaft 43 can be kept in a non-rotating state.

The driving shaft 42 is rotatably supported on the side walls 44*a* and 44*b* through bearings BR3 as shown in FIG. 5B. A driving shaft winding portion 42*a* is formed integrally in the substantially central portion of the driving shaft 42 in its axial direction (the left/right direction in FIG. 5B). The driving shaft winding portion 42*a* is a member for rotatably supporting the conveyance belt 41. When the driving shaft 42 is rotated, the torque thereof is transmitted to the conveyance belt 41 through the driving shaft winding portion 42*a*, so that the conveyance belt 41 is rotated in the conveyance direction of the recording paper P due to the transmitted torque.

In addition, on the both end sides (the left and right sides in FIG. 5B) of the driving shaft winding portion 42*a*, driving shaft pulleys 47*a* and 47*b* are rotatably supported on the driving shaft 42 as shown in FIG. 5B. The driving shaft pulleys 47*a* and 47*b* (rotating members rotatably supported on the driving shaft 42) are members on which the transmission belts 46 are wound. The driving shaft pulleys 47*a* and 47*b* are coupled with the driving shaft 42 through bearings BR4. Thus, the driving shaft pulleys 47*a* and 47*b* are designed to be able to run idle with respect to the driving shaft 42.

Accordingly, when the driving shaft 42 is rotated, the torque thereof is blocked by the bearings BR4. Thus, the torque is hardly transmitted to the driving shaft pulleys 47*a* and 47*b* so that the transmission belts 46 can be kept at rest. In the same manner, when the transmission belts 46 are rotated, the torques thereof are blocked by the bearings BR4. Thus, the torques are hardly transmitted to the driving shaft 42 so that the driving shaft 42 can be kept in a non-rotating state.

Here, a transmission gear GR1 is engraved in the outer circumference of the driving shaft pulley 47*a*. The transmission gear GR1 is connected to a pinion gear GR3 through a connecting gear GR2 as shown in FIG. 5B. The pinion gear GR3 is attached to the rotating shaft of the CP motor 19. Accordingly, when the rotating shaft of the CP motor 19 is rotated, the rotation thereof is transmitted to the transmission gear GR1 through the pinion gear GR3 and the connecting gear GR2 so that the driving shaft pulley 47*a* rotates.

When the driving shaft pulley 47*a* is rotated, the transmission belt 46 (on the left side in FIGS. 5A and 5B) wound on the driving shaft pulley 47*a* is rotated. The rotation of the transmission belt 46 is transmitted to the driven shaft 43 through the driven shaft pulley 43*a* so that the driven shaft pulley 43*b* is rotated together with the driven shaft 43. As a result, the transmission belt 46 (on the right side in FIGS. 5A and 5B) wound on the driven shaft pulley 43*b* is rotated.

In this case, as described above, the torque of the driven shaft 43 is hardly transmitted to the driven shaft roller 48, and the torques of the driving shaft pulleys 47*a* and 47*b* are hardly transmitted to the driving shaft 42. Thus, by driving the CP motor 19, only the transmission belts 46 can be rotated independently without rotating the conveyance belt 41.

Incidentally, gears capable of engaging with the transmission belts 46 formed as timing belts are engraved in the belt seat surfaces of the driving shaft pulleys 47*a* and 47*b* in the same manner as in the driven shaft pulleys 43*a* and 43*b* (see FIG. 5A). Thus, when the CP motor 19 is driven to rotate the driving shaft pulley 47*a*, the torque thereof can be transmitted to the transmission belts 46 efficiently and accurately.

As shown in FIG. 5B, a transmission pulley 42*b* is formed integrally on one side (the right side in FIG. 5B) of the driving shaft 42. The transmission pulley 42*b* is a member for transmitting the torque supplied from the TF motor 21 to the driving shaft 42. The transmission pulley 42*b* is connected to the rotating shaft of the TF motor 21 through a belt 49 or the like. Accordingly, when the rotating shaft of the TF motor 21 is rotated, the rotation thereof is transmitted to the transmission pulley 42*b* through the belt 49 or the like. Thus, the driving shaft 42 rotates.

When the driving shaft 42 is rotated, the rotation thereof is transmitted to the conveyance belt 41 through the driving shaft winding portion 42*a*. As a result, the conveyance belt 41 is rotated in the conveyance direction of the recording paper P. In this event, as described above, the torque of the driving shaft 42 is hardly transmitted to the driving shaft pulleys 47*a* and 47*b*, and the torque of the driven shaft roller 48 is hardly transmitted to the driven shaft 43. Thus, by driving the TF motor 21, only the conveyance belt 41 can be rotated independently without rotating the transmission belts 46.

A rotating shaft for moving the capping unit between the sealing position and the retraction position along the outer circumference of the conveyance belt 41 does not have to be provided separately along the circumference of the conveyance belt 41. Thus, there is an effect that the structure of the inkjet printer 1 can be simplified so that the inkjet printer 1 as a whole can be miniaturized correspondingly.

The pair of transmission belts 46 are disposed on both sides in the width direction of the conveyance belt 41, respectively. The cap unit 60 is provided between the two transmission belts 46. Accordingly, the cap unit 60 can be moved in a steady state. That is, the torques of the two transmission belts 46 are transmitted to the cap unit 60 uniformly between the left and the right in the width direction of the conveyance belt 41, so that the cap unit 60 can be moved to a desired position accurately without being twisted. Thus, the nozzle surfaces 2*a* and 3*a* can be covered properly so that ink can be surely prevented from being evaporated.

Description will be made again with reference to FIGS. 3 and 4. As described above, the capping unit 60 is provided for capping the nozzle surfaces 2*a* and 3*a* in order to prevent ink from being evaporated during long-term suspension of printing, or to recover ink in the purging process or the like. The capping unit 60 chiefly includes first and second cap members 62 and 63, a sheet member 64 and support members 65.

The first cap member 62 is a rubber member for capping the nozzle surfaces 2*a* (see FIG. 1) of the first head unit 2. The first cap member 62 is pasted onto the sheet member 64, which will be described later. As shown in FIG. 3, caps 62Y, 62M, 62C and 62K corresponding to the print heads 2Y, 2M, 2C and 2K of the first head unit 2 are formed integrally with the top side (the near side of the paper of FIG. 3) of the first cap member 62.

Each cap 62Y-62K is formed as a recess portion which is open on its top side (the near side of the paper of FIG. 3) and which is slightly larger than the nozzle area of each nozzle surface 2*a* (see FIG. 1). As shown in FIG. 3, a lip portion is provided in the circumferential edge portion of the recess portion so as to project thereon and have a substantially rectangular shape in top view. Incidentally, each lip portion is formed to be elastically deformable, and to have a substantially uniform projecting height all over the circumference. Accordingly, at the time of capping, each lip portion comes uniformly into close contact with the nozzle surface 2*a* so as to seal the space in the recess portion of each cap 62Y–62K.

In addition, the recess portion of each cap 62Y–62K is formed to have a predetermined depth. Accordingly, the ink reception capacity can be secured to be high enough to surely convey waste ink in the purging process or the like without spilling the waste ink onto the conveyance belt 41. Further, the recess portion is prevented from touching each nozzle surface 2*a* so that the nozzles are not damaged or deformed, or dust or the like is not allowed to adhere to the nozzles. Incidentally, since the second cap member 63 has the same configuration as the first cap member 62, description thereof will be omitted.

The sheet member 64 is a member for retaining the aforementioned first and second cap members 62 and 63 on the outer circumferential side of the conveyance belt 41. As shown in FIG. 3, the sheet member 64 is formed out of a material (e.g. polyester) having flexibility and into a nearly rectangular sheet in top view. The support members 65 are members for supporting the sheet member 64 between the transmission belts 46. The support members 65 are formed out of a metal material into thin lines. As shown in FIG. 3, the pair of support members 65 are laid between the transmission belts 46 so as to extend in parallel to each other and in a direction substantially perpendicular to the conveyance direction (the up/down direction in FIG. 3) of the recording paper P. The sheet member 64 is spread between the pair of support members 65.

As a result, for example, when the transmission belts 46 are rotated in the state shown in FIG. 3, the pair of support members 65 are driven in the rotating directions of the transmission belts 46*so* that the sheet member 64 spread between the pair of support members 65 moves along the outer circumference of the conveyance belt 41. Thus, the first and second cap members 62 and 63 pasted on the sheet member 64 are retracted to the lower surface side (retraction position) of the conveyance belt 41 (see FIGS. 1 and 12A).

As shown in FIG. 1, the conveyance belt unit 70 includes belt guide portions 80 on a lower side thereof. The belt guide portions 80 guide the sheet member 64 so that a lower side of the sheet member 64 travels under a lower side of the conveyance belt 41. Thus, when the first and second cap members 62 and 63 are retracted to the retraction portion, the first and second cap members 62 and 63 do not interfere with the lower side of the conveyance belt 41.

When the transmission belts 46 are rotated backward after the first and second cap members 62 and 63 are retracted to the retraction position, the pair of support members 65 are driven in the rotating directions of the transmission belts 46 in the same manner as described above. As a result, the sheet member 64 spread between the pair of support members 65 moves along the outer circumference of the conveyance belt 41. Thus, the first and second cap members 62 and 63 pasted on the sheet member 64 are moved to the upper surface side (capping position) of the conveyance belt 41 as shown in FIGS. 3 and 12B.

Incidentally, as described above, the sheet member 64 is formed out of a flexible material into a sheet-like shape, and the thin-line-like support members 65 are laid substantially perpendicularly to the conveyance direction of the recording paper P. Accordingly, when the first and second cap members 62 and 63 are cyclically moved between the capping position and the retraction position along the outer circumference of the conveyance belt 41, the sheet member 64 is deformed easily in the direction following the outer circumference of the conveyance belt 41, while the support members 65 are also moved easily along the outer circumference of the conveyance belt 41 without resisting. Thus, the cyclic movement can be performed smoothly.

Since the cap unit 60 is disposed on the sheet member 64, the mechanism for supporting the cap unit 60 can be simplified so that the inkjet printer 1 as a whole can be miniaturized.

The sheet member 64 is spread between the pair of support members 65 made from a metal material. Accordingly, the sheet member 64 can be prevented from being deformed, so that the position of the cap unit 60 can be prevented from being shifted with respect to the nozzle surfaces 2*a* and 3*a*. Thus, the nozzle surfaces 2*a* and 3*a* can be covered surely. In addition, the support members 65 are formed into rod-like pieces and disposed to extend in the width direction of the conveyance belts 41. Accordingly, the deformation of the sheet member 64 is not resisted even when the sheet member 64 is moved along the outer circumference of the conveyance belt 41. Thus, the cap unit 60 can be moved smoothly without requiring an excessive driving force.

The body frame 45 is a member forming center to the conveyance belt unit 7. As shown in FIG. 4, the body frame 45 is formed into a substantially box-like body open on its top (the upper side in FIG. 4) and front (the right side in FIG. 4). The aforementioned side wall frame 44 is received in the internal space of the body frame 45. Protrusion portions 44*a*1 and 44*b*1 (see FIG. 3) projecting on the side walls 44*a* and 44*b* of the side wall frame 44 are fitted into longitudinal grooves 45*a*1 and 45*b*1 defined in the side wall portions (the near side and the deep side of the paper of FIG. 4) of the body frame 45 respectively as shown in FIG. 4. As will be described later, when the side wall frame 44 is lifted up/down, the protrusion portions 44*a*1 and 44*b*1 are guided by the longitudinal grooves 45*a*1 and 45*b*1 so that the side wall frame 44 can be lifted up/down to a desired position accurately and stably.

In addition, as shown in FIG. 4, the elevating shafts 50 are rotatably supported between the side wall portions (the near side and the deep side of the paper of FIG. 4) of the body frame 45 and under the side frame 44 (on the lower side in FIG. 4). Eccentric cams 51 are fixedly attached to the elevating shafts 50. Incidentally, the body frame 45 and the side wall frame 44 are connected through a tension spring SP extended elastically. Accordingly, the side wall frame 44 is urged downward (in the downward direction in FIG. 4) due to the elastically restoring force of the tension spring SP, while a bottom wall 44*c* of the side wall frame 44 is brought into pressure contact with the eccentric cam 51.

Thus, as will be described later, when the elevating shafts 50 are driven to rotate by the torque supplied from the TF motor 21, the eccentric cams 51 are rotated. When the eccentric cams 51 are rotated to increase the eccentricity of the eccentric cams 51, the side wall frame 44 is lifted up (upward in FIG. 4) against the tension spring SP (see FIG. 7), so that the gap between the conveyance belt 41 and the first and second head units 2 and 3 (see FIG. 1) is reduced. On the contrary, when the eccentric cams 51 are rotated to decrease the eccentricity of the eccentric cams 51, the side wall frame 44 is pulled down (downward in FIG. 4) due to the elastically restoring force of the tension spring SP, so that the gap between the conveyance belt 41 and the first and second head units 2 and 3 (see FIG. 1) is expanded. Incidentally, the detailed configuration of a coupling mechanism between the TF motor 21 and the elevating shaft 50, etc. will be described later.

The eccentric cams 51 lift up and down the conveyance belt 41 between the conveyable position and the separate position. When the eccentric cams 51 lift up the conveyance belt 41 toward the conveyable position, the first and second cap members 62 and 63 are pressed onto the nozzle surfaces 2*a* and 3*a* due to the operation of lifting up the conveyance belt 41. Thus, the nozzle surfaces 2*a* and 3*a* can be covered. In this event, the conveyance belt 41 moves up/down while keeping the conveyance surface substantially parallel to the nozzle surfaces 2*a* and 3*a*. Accordingly, the first and second cap members 62 and 63 can be pushed up substantially in parallel to the nozzle surfaces 2*a* and 3*a*. As a result, the first and second cap members 62 and 63 can be pressed onto the nozzle surfaces 2*a* and 3*a* substantially uniformly without slanting so that the nozzle surfaces 2*a* and 3*a* can be covered surely. That is, the first and second cap members 62 and 63 can be brought into close contact with the nozzle surfaces 2*a* and 3*a* without any gap, so that ink can be surely prevented from being evaporated.

In addition, the eccentric cams 51 can be used not only as a swinging mechanism for covering the nozzle surfaces 2*a* and 3*a* with the first and second cap members 62 and 63, but also as a so-called gap adjusting mechanism for adjusting the distance between the nozzle surfaces 2*a* and 3*a* and the conveyance surface of the conveyance belt. Thus, there is an effect that it is unnecessary to provide both the mechanisms individually so that the structure of the inkjet printer 1 can be simplified.

Figure 8:
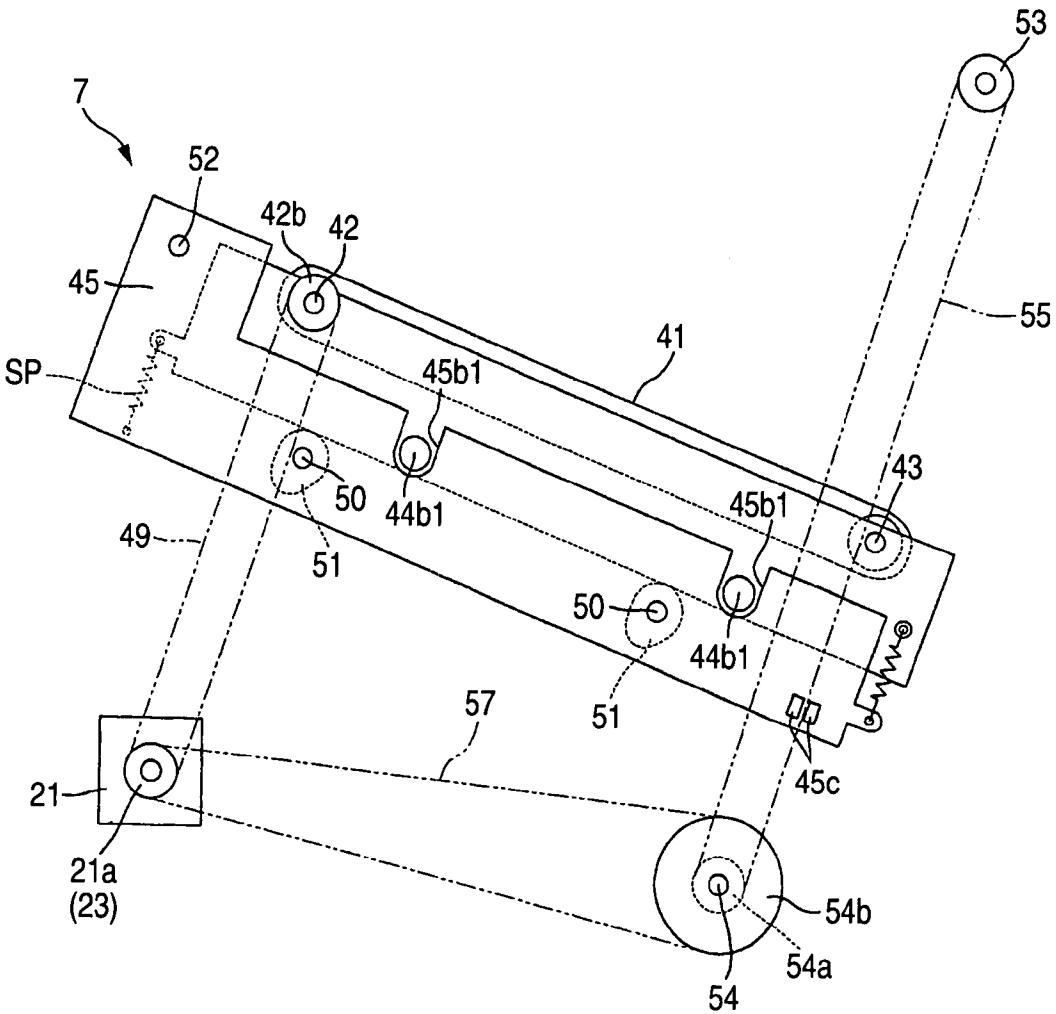
FIG. 8 is a side view of the conveyance belt unit, showing the state where the conveyance belt unit has been swung downward.

In addition, a reference shaft 52 is provided between the side wall portions (the near side and the deep side of the paper of FIG. 4) of the body frame 45 so as to penetrate the rear portion (the left side in FIG. 4) of the side wall frame 44. The both end portions (the near side and the deep side of the paper of FIG. 4) of the reference shaft 52 are rotatably supported on the body (not shown) of the inkjet printer 1. As a result, the body frame 45 (conveyance belt unit 7) is designed to be able to swing around the reference shaft 52 toward the nozzle surfaces 2*a* and 3*a* (see FIG. 1) of the first and second head units 2 and 3 or toward the opposite side thereto (see FIG. 8).

Incidentally, in the conveyance belt unit 7, the body frame 45 thereof is fixed to the body (not shown) using the reference shaft 52 as a reference position. Accordingly, even when the conveyance belt unit 7 is designed to be able to move up/down and swing as described above, the accuracy of the conveyance position of the recording paper P obtained by the conveyance belt 41 is secured so that the printing accuracy can be improved.

As shown in FIG. 4, the transmission pulley 42*b* of the driving shaft 42 is linked with a pulley 21*a* through the belt 49. The pulley 21*a* is attached to the rotating shaft of the TF motor 21. As described above, when the driving/rotating force of the TF motor 21 is transmitted to the driving shaft 42 through the belt 49, the transmission pulley 42*b* and so on, the conveyance belt 41 is rotated by the transmitted force.

As shown in FIG. 4, a connecting portion 45*c* is provided in a front part of the body frame 45 (on the right side in FIG.

4). A belt 55 wound between a fixed pulley 53 and a swinging pulley 54*a* is connected to the connecting portion 45*c*. In addition, a transmission pulley 54*b* of the swinging shaft 54 is linked with the swinging clutch 23 through a belt 56. The swinging clutch 23 is attached to the rotating shaft of the TF motor 21.

Accordingly, the rotating/driving force of the TF motor 21 is transmitted to the swinging shaft 54 through the belt 56. When the swinging shaft 54 is rotated, the belt 55 is rotated through the swinging pulley 54*a* and so on. When the belt 55 is rotated, the connecting portion 45*c* connected to the belt 55 is pulled in the rotating direction of the belt 55. As a result, the conveyance belt unit 7 is swung around the reference shaft 52 toward the position (the conveyable position where the recording paper P can be conveyed, see FIG. 1) where the conveyance belt unit 7 approaches the nozzle surfaces 2*a* and 3*a* of the first and second head units 2 and 3, or the position (separate position) where the conveyance belt unit 7 leaves the nozzle surfaces 2*a* and 3*a* (see FIG. 8).

When the conveyance belt 41 is swung toward the separate position, the conveyance surface of the conveyance belt 41 is separated from the nozzle surfaces 2*a* and 3*a*. Thus, it is possible to secure an enough working space to smoothly perform an operation of removing a recording medium when a paper jam or the like occurs.

On the other hand, when the conveyance belt 41 is swung to the conveyable position, the first and second cap members 62 and 63 are pressed toward the nozzle surfaces 2*a* and 3*a* due to the swinging operation of the conveyance belt 41, so that the nozzle surfaces 2*a* and 3*a* can be covered. Accordingly, the swinging operation can be used not only as a swinging of the conveyance belt 41 in order to deal with a jam, but also as a swinging for covering the nozzle surfaces 2*a* and 3*a* with the first and second cap members 62 and 63. It is therefore unnecessary to provide mechanisms for the both swinging individually, so that the structure of the inkjet printer can be simplified. Thus, there is an effect that the manufacturing cost of the inkjet printer 1 as a whole can be reduced correspondingly.

Figure 6:
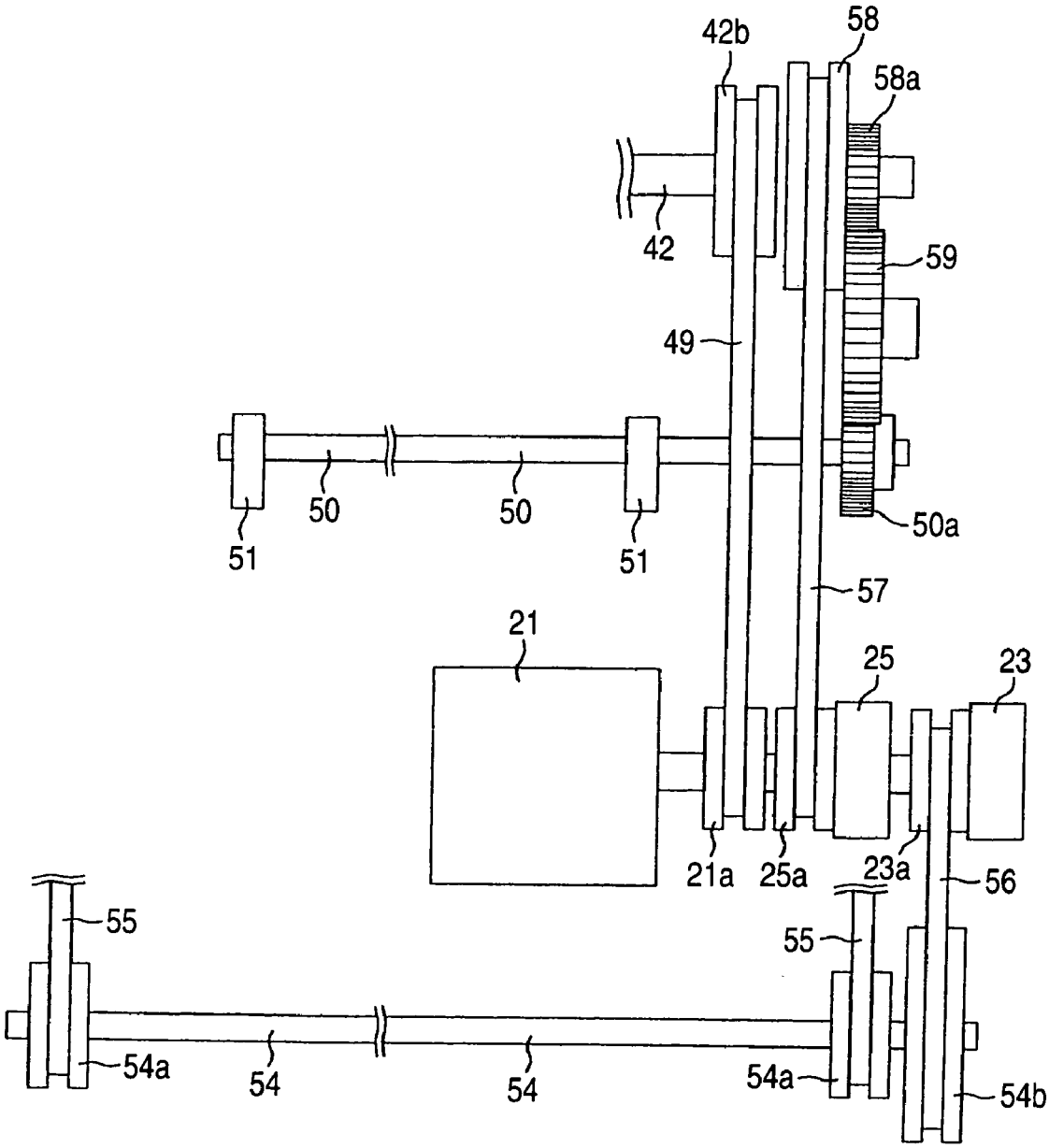
FIG. 6 is a front view of a driving force transmitting mechanism portion.

Here, with reference to FIG. 6, description will be made on the detailed configuration of a driving force transmission mechanism portion for supplying a torque from the TF motor 21 to the conveyance belt 41, the elevating shaft 50 and the swinging shaft 54. FIG. 6 is a front view of the driving force transmission mechanism portion, corresponding to a view of the driving force transmission mechanism portion (the TF motor 21 and so on) viewed from the arrow IV direction in FIG. 4.

The pulley 21*a*, the elevating clutch 25 and the swinging clutch 23 are attached to the rotating shaft of the TF motor 21 as shown in FIG. 6. The transmission pulley 42*b* is linked with the pulley 21*a* through the belt 49 as described above. Thus, the torque of the TF motor 21 can be transmitted to the driving shaft 42 so that the conveyance belt 41 can be driven to rotate.

The elevating clutch 25 is a device for transmitting/blocking the torque of the TF motor 21 from the input shaft side (the rotating shaft of the TF motor 21) to the output shaft side (an output pulley 25*a*). When the elevating clutch 25 is turned on, an electromagnet is excited to suck a movable iron piece. Due to the contact of the movable iron piece with a friction plate, the torque from the input shaft side is transmitted to the output shaft side. When the elevating clutch 25 is turned off, the excitation of the electromagnet is released to separate the movable iron piece. Thus, the transmission of the torque from the input shaft side to the output shaft side is blocked.

A pulley 58 is linked with the output pulley 25*a* of the elevating clutch 25 through a belt 57 as shown in FIG. 6. A coaxial gear 58*a* is formed integrally with an end surface (the right side in FIG. 6) of the pulley 58. As shown in FIG. 6, a gear 59 engages with the gear 58*a*, and a gear 50*a* formed integrally with the elevating shaft 50 is engaged with the gear 59. Incidentally, the eccentric cam 51 is fixedly attached to the elevating shaft 50 as described above. In addition, the pulley 58 and the gear 59 are rotatably supported by not-shown shafts.

When the rotating shaft of the TF motor 21 is rotated and the elevating clutch 25 is turned on, the rotation of the TF motor 21 is transmitted to the output pulley 25*a*, the belt 57, the pulley 58 and the gears 58*a*, 59 and 50*a* in turn, so as to rotate the gear 50*a*. The rotation transmitted to the gear 50*a* is transmitted to the eccentric cam 51 through the elevating shaft 50. As a result, the eccentric cam 51 is rotated.

Figure 7:
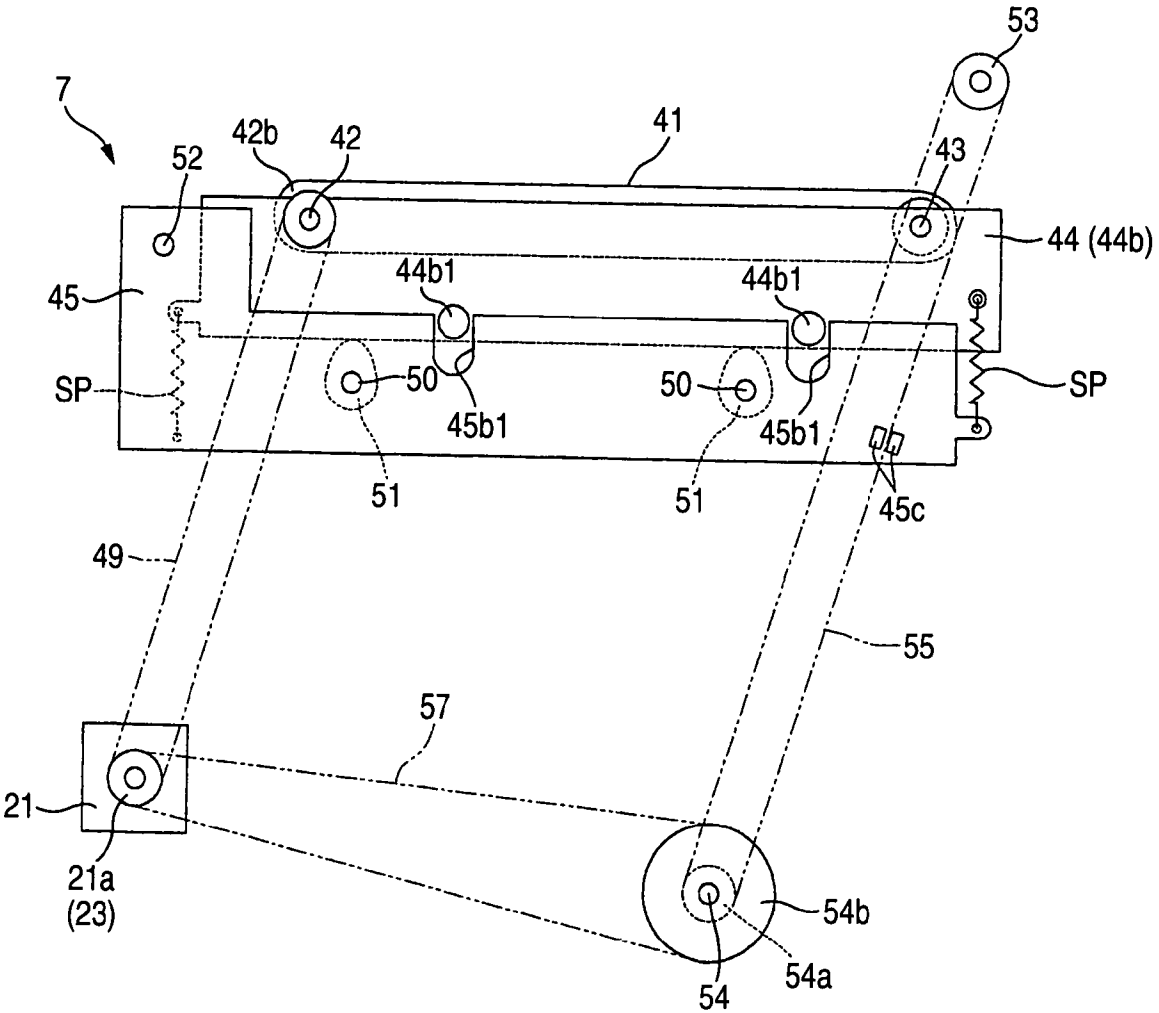
FIG. 7 is a side view of the conveyance belt unit, showing the state where a conveyance belt has been lifted up.

In this event, as described above, as the eccentricity of the eccentric cam 51 increases, the eccentric cam 51 lifts up the bottom wall 44*c* of the side wall frame 44 so as to move up the conveyance belt 41 (see FIG. 7). As the eccentricity of the eccentric cam 51 decreases, the side wall frame 44 is pulled down (downward in FIG. 4) due to the elastically restoring force of the tension spring SP so as to move down the conveyance belt 41 (see FIG. 4).

On the other hand, when the elevating clutch 25 is turned off, the rotation of the TF motor 21 is blocked by the elevating clutch 25 even when the rotating shaft of the TF motor 21 is rotated. Accordingly, the rotation of the TF motor 21 is not transmitted to the output pulley 25*a*. In such a manner, the elevating shaft 50 is not rotated, but the side wall frame 44 is fixed to a predetermined position due to the elastically restoring force of the tension spring SP. Thus, the operation of elevating the conveyance belt 41 is not performed.

Figure 13:
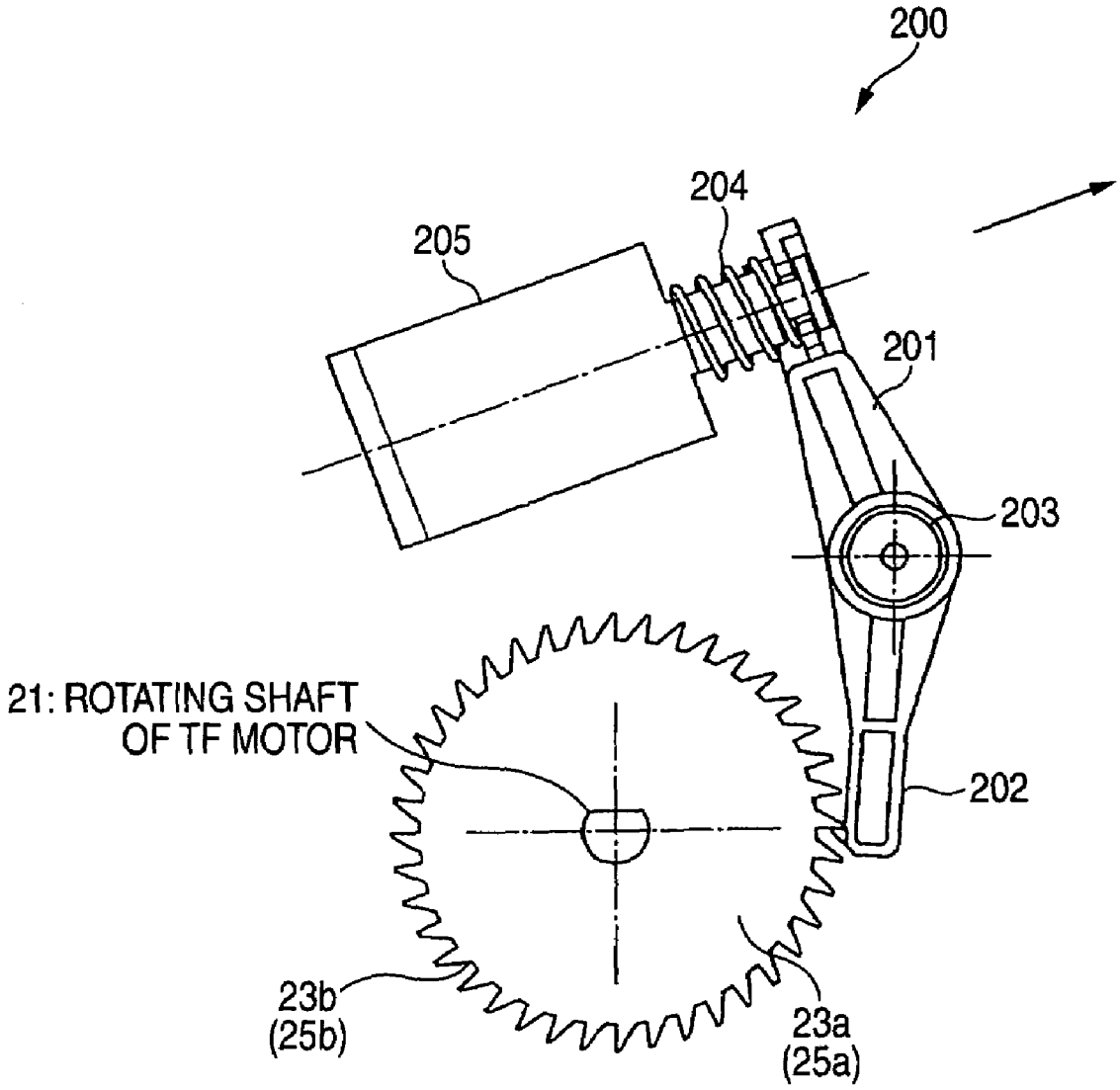
FIG. 13 is a side view of a holding mechanism 200.

Incidentally, a holding mechanism 200 is provided and prevents the output pulley 25*a* from rotating in the clockwise direction when the elevating clutch 25 is turned off. FIG. 13 is a side view of the holding mechanism 200. As shown in FIG. 13, the holding mechanism 200 includes a ratchet member 201, a compression spring 204, and a solenoid 205. The ratchet member 201 includes a claw 202 and a pivot 203. The claw 202 has a protrusion, which can engage with ratchet gears 25*b*, at a tip end portion thereof. The output pulley 25*a* has the ratchet gears 25*b* on the outer circumferential surface thereof. The claw 202 can swing around the pivot 203. The ratchet member 201 is connected to a shaft of the solenoid 205 and biased by the compression spring 204 in an arrowed direction.

When the elevating clutch 25 is turned off, the solenoid 205 is energized so as to move the shaft of the solenoid 205 in an opposite direction to the arrowed direction against the biasing force of the compression spring 204. Then, the protrusion of the claw 202 engages with the ratchet gears 25*b* so that the output pulley 25*a* is prevented from rotating in the clockwise direction. Since the output pulley 25*a* cannot rotate in the clockwise direction, the gears 50*a* and 58*a* cannot rotate in the clockwise direction. As a result, the eccentric cum 51 keeps lifting up the sidewall frame 44 against the weight of the side wall frame 44.

When the elevating clutch 25 is turned on, the solenoid 205 is not energized and the compression spring 204 moves the shaft of the solenoid 205 by its biasing force in the arrowed direction. The ratchet member 201 is moved in the arrowed direction and the protrusion of the claw 202 disengage from the ratchet gears 25*b*. Accordingly, the output pulley 25*a* can rotate in the clockwise direction.

The swinging clutch 23 is arranged in the same manner as the aforementioned elevating clutch 25. That is, the swinging clutch 23 is a device for transmitting/blocking the torque of the TF motor 21 from the input shaft side (the rotating shaft of the TF motor 21) to the output shaft side (an output pulley 23*a*). The transmission pulley 54*b* is linked with the output pulley 23*a* of the swinging clutch 23 through the belt 56 as shown in FIG. 6. The swinging pulley 54*a* is linked with the transmission pulley 54*b* through the swinging shaft 54. Incidentally, the swinging pulley 54*a* and the transmission pulley 54*b* are formed integrally with the swinging shaft 54.

When the rotating shaft of the TF motor 21 is rotated and the swinging clutch 23 is turned on, the rotation of the TF motor 21 is transmitted to the output pulley 23*a*, the belt 56 and the transmission pulley 54*b* in turn, so as to rotate the pulley 54*b*. The rotation transmitted to the transmission pulley 54*b* is transmitted to the transmission pulley 54*a* through the swinging shaft 54. As a result, the transmission pulley 54*a* is rotated. Then, the belt 55 wound between the transmission pulley 54*a* and the pulley 53 (see FIG. 4) is rotated by the rotation of the transmission pulley 54*a*.

In this event, as described above, when the belt 55 is rotated in one direction, the connecting portion 45*c* connected to the belt 55 is pulled in the rotating direction of the belt 55. As a result, the conveyance belt unit 7 is swung around the reference shaft 52 toward the nozzle surfaces 2*a* and 3*a* (see FIG. 1) of the first and second head units 2 and 3 (see FIG. 4). On the contrary, when the belt 55 is rotated in the other direction, the connecting portion 45*c* connected to the belt 55 is pulled in the rotating direction of the belt 55. As a result, the conveyance belt unit 7 is swung around the reference shaft 52 toward the opposite direction to the nozzle surfaces 2*a* and 3*a* of the first and second head units 2 and 3 (see FIG. 8).

On the other hand, when the swinging clutch 23 is turned off, the rotation of the TF motor 21 is blocked by the swinging clutch 23 even when the rotating shaft of the TF motor 21 is rotated. Accordingly, the rotation of the TF motor 21 is not transmitted to the output pulley 23*a*. In such a manner, the swinging shaft 54 is not rotated, but the conveyance belt unit 7 is fixed in a predetermined position. Thus, the operation of swinging the conveyance belt unit 7 (the conveyance belt 41) is not performed.

Another holding mechanism 200 having the same configuration as described above is also provided for the output pulley 23*a*. Thus, even when the conveyance belt unit 7 is located at the conveyable position (FIG. 7) or the separate position (FIG. 8) and the swinging clutch 23 is turned off, the conveyance belt unit 7 stays at the conveyable position or the separate position against its own weight.

In such a manner, the driving force transmitting mechanism portion in this embodiment is designed to be able to transmit/block the torque supplied from the TF motor 21 to the elevating shaft 50 and the swinging shaft 54. Accordingly, driving for rotating the conveyance belt 41, driving for elevating the conveyance belt 41 and driving for swinging the conveyance belt 41 can be performed by a single driving source (the TF motor 21). It is therefore unnecessary to provide a driving source for each driving operation, and it is possible to simplify the configuration and reduce the number of parts. Thus, the manufacturing cost of the inkjet printer 1 as a whole can be reduced correspondingly.

Figure 9:
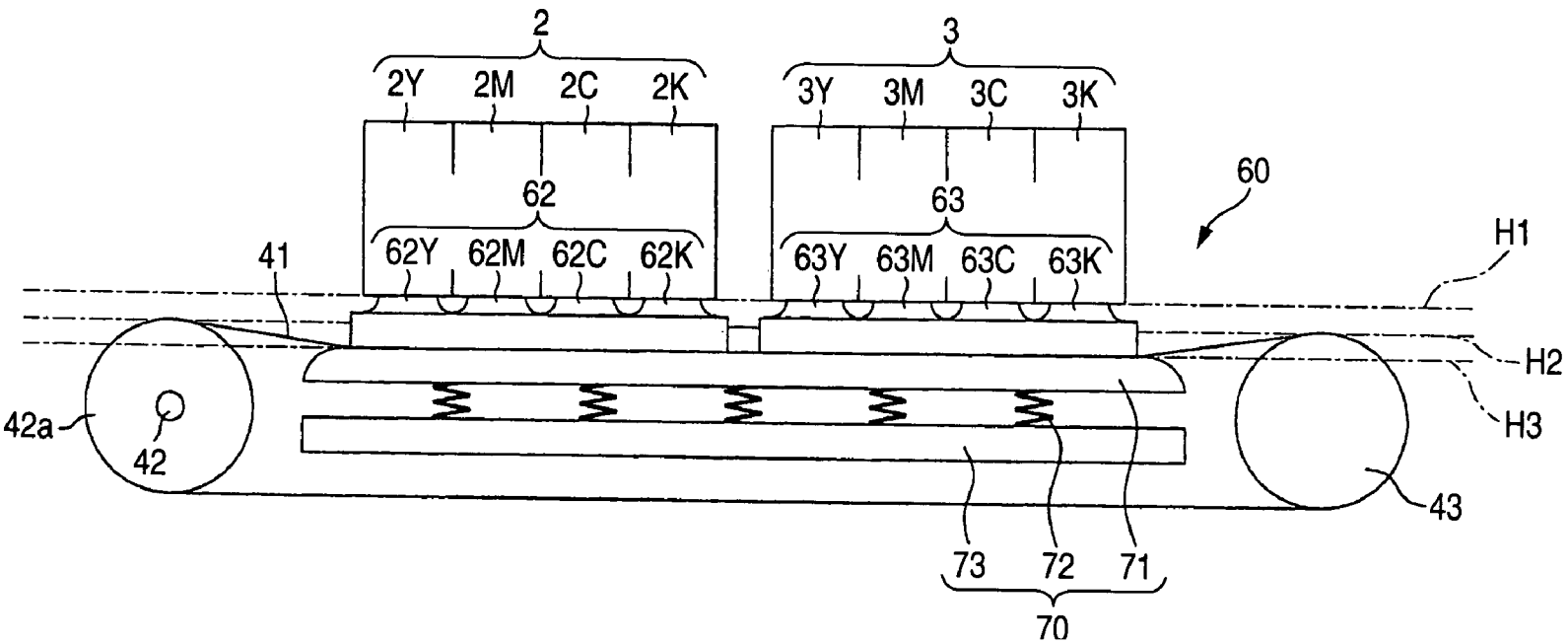
FIG. 9 is a side view of a belt seat unit.

Next, description will be made on the belt seat unit 70 with reference to FIG. 9. FIG. 9 is a side view of the belt seat unit 70, showing the state where the nozzle surfaces 2*a* and 3*a* of the first and second head units 2 and 3 have been capped with the first and second cap members 62 and 63. Incidentally, in FIG. 9, the conveyance belt unit 7, the capping unit 60 and so on are partially omitted in order to simplify the respective constituent components and make them understood easily. In addition, in FIG. 9, the reference sign H1 represents a surface (hereinafter referred to as "head surface") on the nozzle surfaces 2*a* and 3*a*; H2, a conveyance surface of the recording paper P; and H3, a pressure contact surface of a belt seat member 71.

As described above, the belt seat unit 70 is chiefly constituted by the belt seat member 71, compression spring members 72 and a base 73 in order to press the first and second cap members 62 and 63 onto the nozzle surfaces at the time of capping so as to bring the first and second cap members 62 and 63 into close contact with the nozzle surfaces 2*a* and 3*a*.

The belt seat member 71 is a member to be brought into contact with the inner circumferential surface of the conveyance belt 41. The belt seat member 71 is formed out of a resin material into a flat plate having a substantially rectangular shape in top view. The belt seat member 71 has a top surface (the surface on the upper side in FIG. 9) formed to be substantially flat, while the belt seat member 71 is formed substantially in parallel to the head surface H1 and the conveyance surface H2. Accordingly, the belt seat member 71 can press the first and second cap members 62 and 63 onto the nozzle surfaces 2*a* and 3*a* substantially uniformly so that the caps 62Y–62K and 63Y–63K can be brought into close contact with the nozzle surfaces 2*a* and 3*a* surely.

As shown in FIG. 9, a plurality of compression spring members 72 are disposed on the lower surface side (the lower side in FIG. 9) of the belt seat member 71. The belt seat member 71 is supported on the base 73 through the compression spring members 72. The base 73 is fixed on the side walls 44*a* and 44*b* (see FIG. 3) of the side wall frame 44 so as to be laid therebetween. Accordingly, when the belt seat member 71 is retracted in the opposite direction to the nozzle surfaces 2*a* and 3*a* (downward in FIG. 9) at the time of capping the nozzle surfaces 2*a* and 3*a*, the compression spring members 72 can be compressed and deformed between the base 73 and the belt seat member 71. Incidentally, the pressure contact surface H3 designates the upper surface of the belt seat member 71 in this state.

As a result, the belt seat member 71 is urged toward the nozzle surfaces 2*a* and 3*a* (up ward in FIG. 9) due to the elastically restoring force of the compression spring members 72. Accordingly, due to the urging force, the first and second cap members 62 and 63 are pressed onto the nozzle surfaces 2*a* and 3*a* so that the caps 62Y–62K and 63Y–63K can be brought into firm and close contact with the nozzle surfaces 2*a* and 3*a*. Thus, inks can be surely prevented from being evaporated.

Incidentally, the height (the height in the up/down direction in FIG. 9) of the first and second cap members 62 and 63 corresponds to the distance (gap length) between the opposed surfaces of the head surface H1 and the conveyance surface H2. The height is designed to be larger (thicker) than the minimum value (gap length when the conveyance belt 41 is moved up most closely to the head surface H1) of a range which can be adjusted by adjusting the gap. In addition, the initial position (the position when the belt seat member 71 does not press the first and second gap members 62 and 63) of the belt seat member 71 is set down to be a position in which if the aforementioned gap length takes the minimum value, the upper surface (the surface on the upper side in FIG. 9) of the belt seat member 71 will be brought into contact with the inner circumferential surface of the conveyance belt 41, and at least the belt seat member 71 will be pushed down (downward in FIG. 9) further from the initial position so that the compression spring members 72 can be compressed and deformed.

Next, description will be made on the capping method for capping the nozzle surfaces 2*a* and 3*a* of the first and second head units 2 and 3 by use of the capping unit 60 in the inkjet printer 1 configured thus.

The capping unit 60 is retracted in a position (retraction position) under the conveyance belt 41 during printing of the inkjet printer 1 (see FIG. 1). For example, when printing is to be suspended for a long time or it is concluded that there occurs necessity of performing a purging process, the ink-jet printer 1 first swings the conveyance belt unit 7 downward, that is, in the opposite direction to the nozzle surfaces 2*a* and 3*a* so as to cap the nozzles surfaces 2*a* and 3*a* with the capping unit 60 (see FIG. 8).

Incidentally, this swinging operation is performed as described above. That is, in the state where the swinging clutch 23 is turned on, the TF motor 21 is driven to rotate in one direction. The torque of the TF motor 21 is transmitted to the swinging shaft 54 (see FIG. 6).

After the conveyance belt unit 7 is driven to swing downward (see FIG. 8), the capping unit 60 is next moved along the outer circumference of the conveyance belt 41 so that the capping unit 60 is disposed on the upper surface side of the conveyance belt 41, that is, in the capping position (see FIG. 3). In such a manner, the movement of the capping unit 60 to the capping position is performed in the state where the conveyance belt unit 7 has been driven to swing downward. Accordingly, the capping unit 60 in transit can be prevented from touching the nozzle surfaces 2*a* and 3*a* to thereby damage or deform the nozzle surfaces 2*a* and 3*a*.

Incidentally, the movement to the capping position is performed as described above. That is, the CP motor 19 is driven to rotate in a predetermined direction. The torque of the CP motor 19 is transmitted to the capping unit 60 through the transmission belts 46 (see FIG. 3).

After the capping unit 60 is disposed in the capping position (see FIG. 3), the conveyance belt unit 7 is next swung upward, that is, toward the nozzle surfaces 2*a* and 3*a* (see FIG. 4). As a result, the caps 62Y–62K and 63Y–63K (see FIG. 4) of the capping unit 60 are disposed to face the nozzle surfaces 2*a* and 3*a* (see FIG. 1) of the print heads 2Y–2K and 3Y–3K respectively.

Incidentally, the capping unit 60 is not shown in FIG. 4. In addition, the swinging operation is performed as described above. That is, in the state where the swinging clutch 23 is turned on, the TF motor 21 is driven to rotate in the other direction so as to transmit the torque of the TF motor 21 to the swinging shaft 54 (see FIG. 6).

After the capping unit 60 is disposed to face the nozzle surfaces 2*a* and 3*a*, the conveyance belt 41 is lifted up toward the nozzle surfaces 2*a* and 3*a* (see FIG. 7). As a result, the capping unit 60 is pushed up toward the first and second head units 2 and 3 by the conveyance belt 41, and predetermined capping pressure is generated due to the urging force of the belt seat unit 70. Thus, the caps 62Y–62K and 63Y–63K of the capping unit 60 are brought into firm and close contact with the nozzle surfaces 2*a* and 3*a* of the print heads 2Y–2K and 3Y–3K respectively. Then, capping is completed (see FIG. 9).

Incidentally, the lifting operation of the conveyance belt 41 is performed as described above. That is, in the state where the elevating clutch 25 is turned on, the TF motor 21 is driven to rotate in one direction so as to transmit the toque of the TF motor 21 to the elevating shaft 50 (see FIG. 6).

When printing is resumed after capping, the inkjet printer 1 carries out the aforementioned operations in reverse. That is, first, the conveyance belt 41 is driven to move down so that the capping unit 60 is separated from the nozzle surfaces 2*a* and 3*a* (see FIG. 4). After that, the conveyance belt 41 is swung downward (in the opposite direction to the nozzle surfaces 2*a* and 3*a*) (see FIG. 8). Next, the capping unit 60 is moved along the outer circumference of the conveyance belt 41 so that the capping unit 60 is disposed in the retraction position. After that, the conveyance belt 41 is swung upward (toward the nozzle surfaces 2*a* and 3*a*) (see FIG. 1). Thus, the conveyance belt 41 is disposed to face the nozzle surfaces 2*a* and 3*a* so as to be set in a printable state.

In such a manner, according to the inkjet printer 1 in this embodiment, the nozzle surfaces 2*a* and 3*a* can be capped using the swinging operation and the elevating operation of the conveyance belt 41 with the first and second head units 2 and 3 being fixed. It is therefore unnecessary to move heads as in a background-art serial type inkjet printer, and it is possible to secure the positional accuracy of the heads. Thus, the printing accuracy can be improved correspondingly.

Although the invention has been described above based on the embodiment, the invention is not limited to the aforementioned embodiment at all. It can be imagined easily that various improvements and modifications can be made without departing from the gist of the invention.

For example, in the aforementioned embodiment, the belt seat unit 70 includes the compression spring members 72, and the capping unit 60 is pressed onto the nozzle surfaces 2*a* and 3*a* by the elastically restoring force of the compression spring members 72 (see FIG. 9). However, the invention is not always limited to such a configuration. Instead of or in addition to the configuration, the capping unit 60 may include the compression spring members 72.

Figure 10:
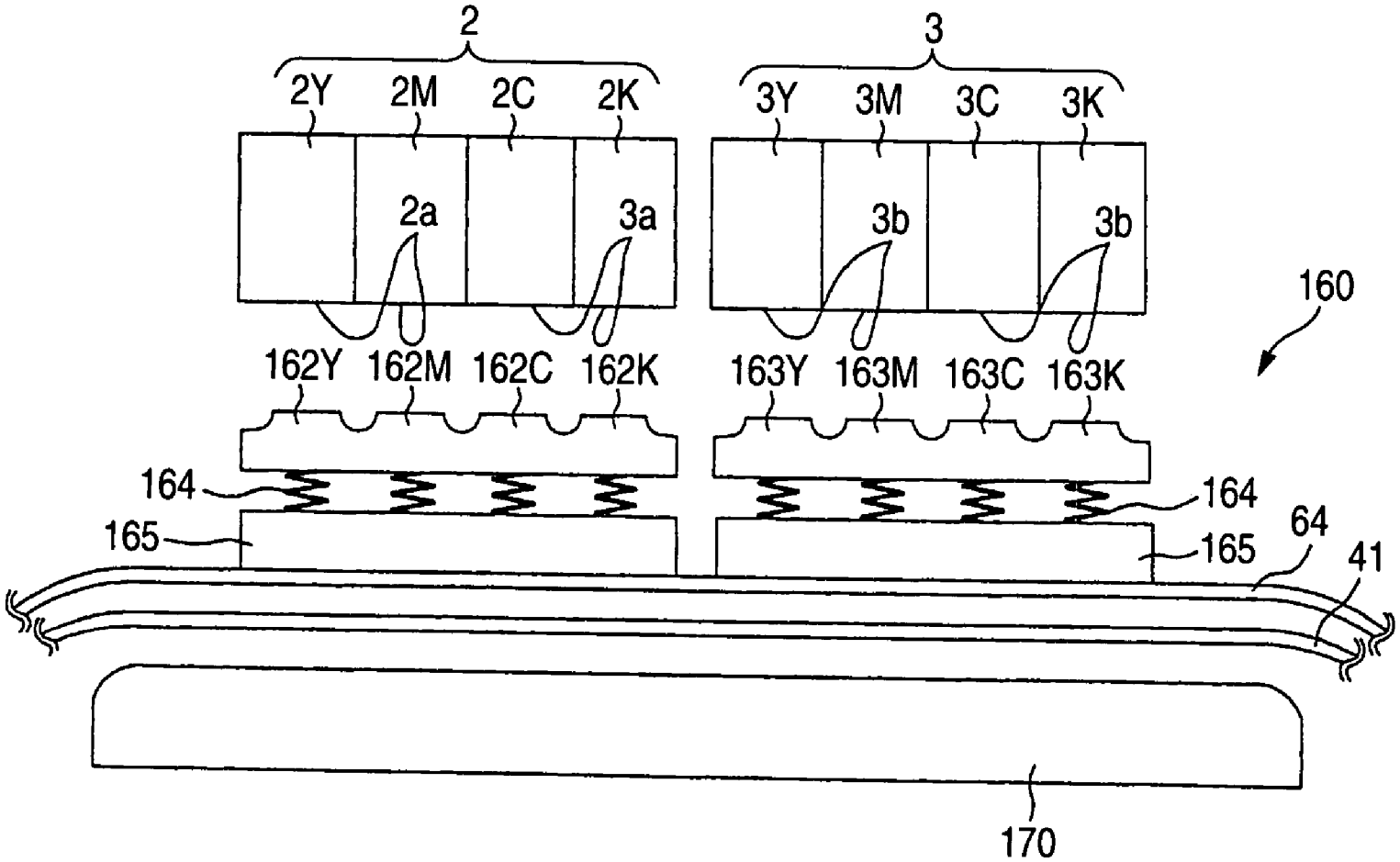
FIG. 10 is aside view of a capping unit in a modification.

An example of such a modification will be described below. Incidentally, parts the same as those in the aforementioned embodiment are denoted by the same reference numerals correspondingly, and description thereof will be omitted. FIG. 10 is a side view of a capping unit 160 in this modification. Caps 162Y–162K and 163Y–163K of the capping unit 160 are substantially arranged in the same manner as the aforementioned caps 62Y–62K and 63Y–63K. As shown in FIG. 10, a plurality of compression spring members 164 are disposed on the lower surface side (the lower side in FIG. 10) of the caps 162Y–162K and 163Y–163K, and the caps 162Y–162K and 163Y–163K are supported on a base 165 through the compression spring members 164. In addition, the base 165 is fixedly pasted onto the sheet member 64.

A belt seat member 170 is disposed on the inner circumferential surface side of the conveyance belt 41 as shown in FIG. 10. Differently from that in the aforementioned embodiment, the belt seat member 170 is not provided with the compression spring members 72, but is fixed directly to the side walls 44*a* and 44*b* of the side wall frame 44 so as to be laid therebetween. Accordingly, when the caps 162Y–162K and 163Y–163K are retracted in the opposite direction to the nozzle surfaces 2*a* and 3*a* (downward in FIG. 10) at the time of capping the nozzle surfaces 2*a* and 3*a*, the retracting motion is regulated by the belt seat member 170 so that the compression spring members 164 can be compressed and deformed.

As a result, the caps 162Y–162K and 163Y–163K are urged toward the nozzle surfaces 2*a* and 3*a* (upward in FIG.

10) due to the elastically restoring force of the compression spring members 164. By predetermined capping pressure formed due to the urging force, the caps 162Y–162K and 163Y–163K are brought into firm and close contact with the nozzle surfaces 2*a* and 3*a*. Thus, inks can be surely prevented from being evaporated.

In addition, in the aforementioned embodiment, the capping unit 60 is fixedly laid between the transmission belts 46 of the conveyance belt unit 7 so that the capping unit 60 is moved along the outer circumference of the conveyance belt 41 through the transmission belts 46, that is, while interlocking with the driving shaft 42 and the driven shaft 43 of the conveyance belt unit 7 (see FIG. 3). However, the invention is not always limited to such a configuration. For example, the capping unit 60 may be designed to be moved independently of the conveyance belt unit 7 (the driving shaft 42 and the driven shaft 43).

Figure 11:
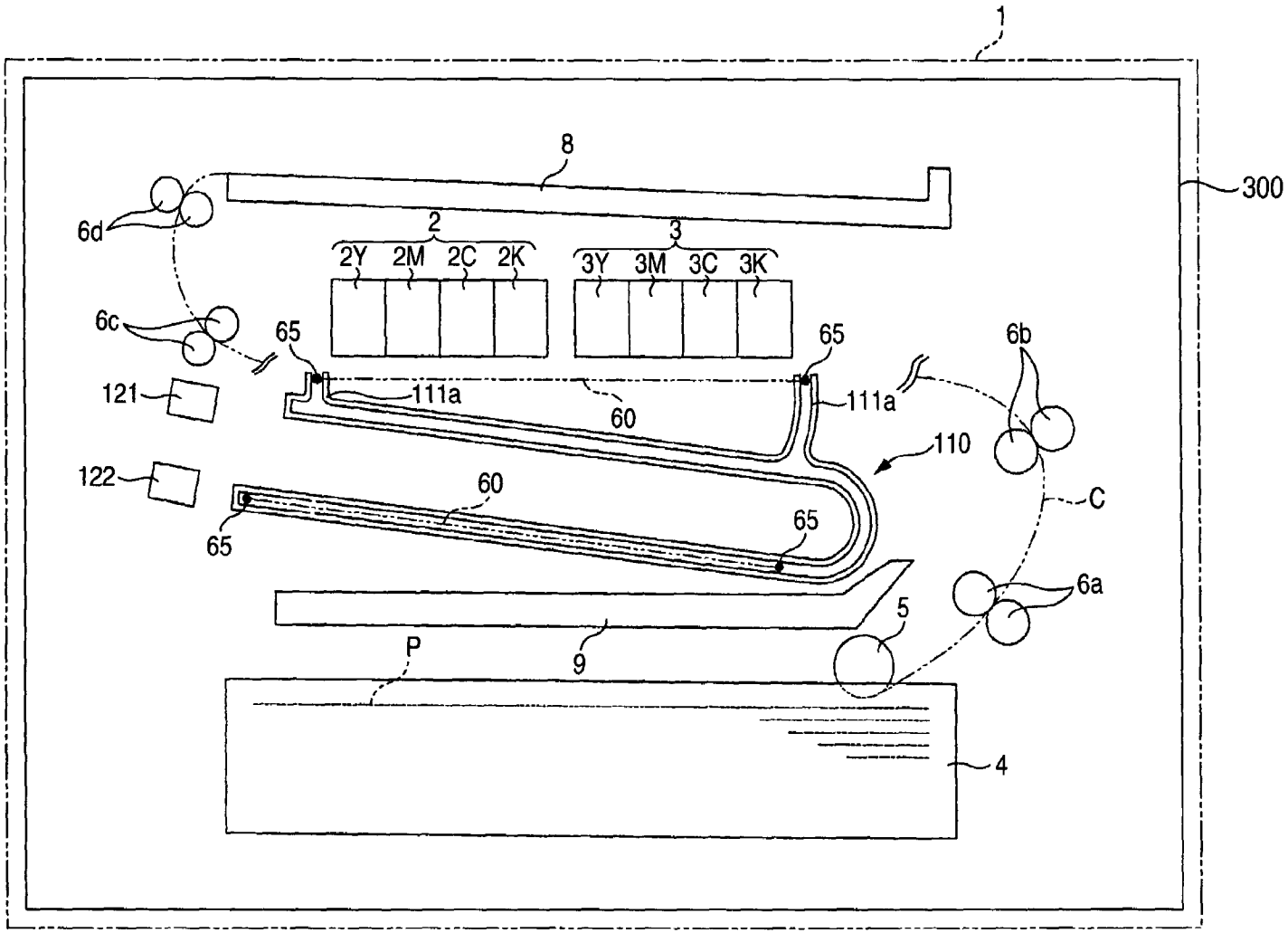
FIG. 11 is a schematic view schematically showing the overall configuration of an inkjet printer according to a modification.

An example of such a modification will be described below. Incidentally, parts the same as those in the aforementioned embodiment are denoted by the same reference numerals correspondingly, and description there of will be omitted. FIG. 11 is a schematic view schematically showing the overall configuration of the inkjet printer 1 in this modification. Incidentally, in FIG. 11, the conveyance belt unit 7 is not shown, but the capping unit 60 is schematically shown using the chain double-dashed line. In addition, the capping unit 60 is shown at two places, that is, in the retraction position and the capping position.

In body side walls 300 (side wall plate members; shown in FIG. 11 in a transparent manner) of the inkjet printer 1, a pair of guide grooves 111 (only one of which is shown in FIG. 11) are defined to be opposed to each other as shown in FIG. 11. The guide grooves 111 are guide grooves for moving the capping unit 60 along the outer circumference of the conveyance belt 41. The guide grooves 111 are formed into concave grooves each having a U-shape in section, so that the guide grooves 111 can movably support the support members 65 of the capping unit 60, which are fitted into the concave grooves.

The guide grooves 111 are formed to follow the outer circumference of the conveyance belt 41 (see FIG. 8) swung downward, while two branch grooves 111*a* extending upward (on the upper side in FIG. 11) are provided contiguously to the guide grooves 111. The pair of support members 65 of the capping unit 60 are supported by the guide grooves 111. In addition, one of the support members 65 is connected to a drive unit 121 through a wire or the like, while the other support member 65 is connected to a drive unit 122 likewise.

Accordingly, when capping is performed, the capping unit 60 is pulled along the guide grooves 111 through the wires or the like due to the driving force of the drive unit 121. Next, the conveyance belt 41 is driven to swing upward (toward the nozzle surfaces 2*a* and 3*a*) (see FIG. 4). As a result, the support members 65 are guided by the branch grooves 111*a* so that the capping unit 60 is pushed up. When the conveyance belt 41 is then driven to move up (toward the nozzle surfaces 2*a* and 3*a*) (see FIG. 7), the capping unit 60 is pushed up by the conveyance belt 41. Thus, the nozzle surfaces 2*a* and 3*a* are capped.

In such a manner, according to this embodiment, the capping unit 60 can be moved while being guided by the guide grooves 111. Accordingly, the capping unit 60 can be moved accurately to cap the nozzle surfaces 2*a* and 3*a* properly. Incidentally, for a printing process after the capping, the aforementioned operations are carried out in a reverse order, while the capping unit 60 is pulled along the guide grooves 111 by the drive unit 12. Thus, the capping unit 60 can be retracted to the retraction position.

In addition, in the aforementioned embodiment, after the conveyance belt unit 7 is swung and moved, the conveyance belt. 41 is further moved up (see FIG. 7) so that the capping unit 60 is pushed up toward the nozzle surfaces 2*a* and 3*a* to thereby perform capping on them. However, the invention is not always limited to such a configuration. Of course, capping may be performed by the following configuration. That is, the capping unit 60 is pushed up toward the nozzle surfaces 2*a* and 3*a*, for example, not by moving up the conveyance belt 41 but by swinging and moving the conveyance belt 41.

In addition, in the aforementioned embodiment, the capping unit 60 is designed so that the first and second cap members 62 and 63 are pasted on the sheet member 64. However, the invention is not always limited to such a configuration. For example, the first and second cap members 62 and 63 may be omitted while lip portions are formed in the sheet member 64. Alternatively, only recess portions may be formed in the sheet member 64.

What is claimed is:

1. An inkjet printer comprising:

an inkjet head including a plurality of nozzles that eject ink;

a sealing member that covers a nozzle surface of the inkjet head;

a conveyance unit including an endless conveyance belt that carries a recording medium in a conveyance direction substantially parallel to the nozzle surface;

a first moving unit that moves the sealing member along an outer circumference of the conveyance belt between a first position and a second position, wherein the first position is located above the conveyance belt and faces the nozzle surface of the inkjet head; and the second position is located under the conveyance belt; and a second moving unit that moves the conveyance belt between a conveyable position and a separate position, wherein the conveyable position is close to the nozzle surface of the inkjet head; and the separate position is separated from the nozzle surface;

wherein when the conveyance belt is located at the conveyable position and the sealing member is located at the first position, the conveyance belt presses the sealing member toward the nozzle surface so that the sealing member covers the nozzle surface; and when the sealing member is located at the first position and the second moving unit moves the conveyance belt from the conveyable position to the separate position, the sealing member is separate from the nozzle surface.

2. The inkjet printer according to claim 1, wherein the conveyable position is closer to the nozzle surface than the separate position.

3. The inkjet printer according to claim 1, wherein the second moving unit includes a swinging unit that swings the conveyance belt between the conveyable position and the separate position.

4. The inkjet printer according to claim 1, wherein the second moving unit includes an elevating unit that lifts up and down the conveyance belt between the conveyable position and the separate position while keeping a conveyance surface of the conveyance belt substantially parallel to the nozzle surface of the inkjet head.

5. The inkjet printer according to claim 1, further comprising:

a first shaft;

a second shaft, wherein the conveyance belt is wound on the first shaft and the second shaft;

a first rotating member that is supported on the first shaft and rotates independently of the first shaft;

a second rotating member that is supported on the second shaft, rotates independently of the second shaft, and is inserted between the conveyance belt and the second shaft;

a first drive unit that giving a rotating/driving force to one of (a) the first shaft and (b) the second rotating member; and a transmission belt that is wound between the second shaft and the first rotating member and supports the sealing member, wherein:

the first moving unit includes a second drive unit that gives a rotating/driving force to one of (c) the second shaft and (d) the first rotating member; and the sealing member is disposed on the outer circumferential surface side of the conveyance belt.

6. The inkjet printer according to claim 5, wherein:

the first drive unit gives the rotating/driving force to the first shaft; and the second drive unit gives the rotating/driving force to the first rotating member.

7. The inkjet printer according to claim 5, wherein:

the first rotating member includes a pair of first rotating members;

the transmission belt includes a pair of transmission belts;

the first rotating members and the transmission belts are disposed on both sides of the conveyance belt in a direction perpendicular to the conveyance direction; and the sealing member is disposed on the outer circumferential surface side of the conveyance belt so as to be laid between the pair of transmission belts.

8. The inkjet printer according to claim 7, further comprising:

a sheet member that is formed out of a flexible sheet-like piece and is laid between the transmission belts disposed on the width-direction opposite end sides of the conveyance belt, wherein the sealing member is disposed on the sheet member.

9. The inkjet printer according to claim 8, further comprising:

a pair of support members that are laid between the transmission belts in the direction perpendicular to the conveyance direction, and are formed of metal rod materials, wherein the sheet member is spread between the pair of support members.

10. The inkjet printer according to claim 5, wherein:

gears are engraved on outer circumferential surfaces of the second shaft and the first shaft rotating members and at portions where the transmission belts are wound; and the transmission belt is a timing belt that engages with the gears engraved on the outer circumferential surfaces of the second shaft and the first shaft rotating members.

11. The inkjet printer according to claim 1, further comprising:

side wall plate members that are disposed to face each other on both sides of the conveyance belt in a direction perpendicular to the conveyance direction; and groove portions that are defined in the side wall plate members, and that parts of the sealing member are inserted into, wherein:

when the first moving unit moves the sealing member between the first position and the second position, the guide portions guide the parts of the sealing member along the guide portions.

12. The inkjet printer according to claim 1, further comprising:

a belt seat member that is disposed an inner circumferential surface side of the conveyance belt to face an inner circumferential surface of the conveyance belt, wherein:

the belt seat member abuts against the inner circumferential surface of the conveyance belt to regulate retraction movement of the conveyance belt in a direction to leave the nozzle surface, when the conveyance belt is located at the conveyable position; the sealing member is located at the first position; and the conveyance belt presses the sealing member toward the nozzle surface.

13. The inkjet printer according to claim 12, further comprising:

a belt seat support member that is elastically deformable and supports the belt seat member, wherein:

when the belt seat member abuts against the inner circumferential surface of the conveyance belt, the belt seat support member is elastically deformed and urges the belt seat member toward the inner circumferential surface of the conveyance belt by an elastically restoring force of the belt seat support member.

14. The inkjet printer according to claim 1, further comprising:

a sealing portion support member that is elastically deformable and supports the sealing member, wherein:

when the sealing member abuts against the nozzle surface of the inkjet head, the sealing portion support member is elastically deformed and urges the sealing member toward the nozzle surface of the inkjet head by an elastically restoring force of the sealing portion support member.

* * * * *